US006102775A

United States Patent [19]

Ushio et al.

[11] Patent Number: 6,102,775

[45] Date of Patent: Aug. 15, 2000

[54] FILM INSPECTION METHOD

[75] Inventors: Yoshijiro Ushio, Yokohama; Motoo Koyama, Tokyo, both of Japan

[73] Assignee: Nikon Corporation, Tokyo, Japan

[21] Appl. No.: 09/062,636

[22] Filed: Apr. 20, 1998

[30] Foreign Application Priority Data

Apr. 18, 1997 [JP] Japan ..... 9-116534
Oct. 3, 1997 [JP] Japan ..... 9-270909

[51] Int. Cl.[7] ..... B24B 49/12

[52] U.S. Cl. ..... 451/6; 451/8; 451/41

[58] Field of Search ..... 451/6, 8, 41, 59, 451/63

[56] References Cited

U.S. PATENT DOCUMENTS

| | | | |
|---|---|---|---|
| 5,081,796 | 1/1992 | Schultz . | |
| 5,433,651 | 7/1995 | Lustig et al. | 451/6 |
| 5,672,091 | 9/1997 | Takahashi et al. | 451/6 |
| 5,730,642 | 3/1998 | Sandhu et al. | 451/6 |
| 5,738,562 | 4/1998 | Doan et al. | 451/5 |
| 5,823,853 | 10/1998 | Bartels et al. | 451/5 |
| 5,838,447 | 11/1998 | Hiyama et al. | 356/381 |
| 5,910,846 | 6/1999 | Sandhu | 356/382 |
| 5,964,643 | 10/1999 | Birang et al. | 451/6 |

*Primary Examiner*—Timothy V. Eley
*Attorney, Agent, or Firm*—Morgan, Lewis & Bockius LLP

[57] ABSTRACT

In the polishing apparatus and film inspection method, a polishing apparatus for polishing an object causes a relative movement between a polishing body and the polishing object. A polishing agent is then interposed between the polishing body and the polishing object. The polishing apparatus includes an optical measuring system capable of measuring at least one of a polished surface state of the polishing object or a film thickness of the polishing object and a position detection system capable of detecting relative positions of the optical measuring system and the polishing object. A control system is also included, and is capable of controlling at least one of the optical measuring system or the polishing object in accordance with position detection system signals so that prescribed endpoint detection regions of the polishing object are measured by the optical measuring system. A film thickness inspection method optically detects the film thickness of the outermost layer on a semiconductor substrate on which desired wiring patterns are formed in predetermined chip regions by laminating a plurality of layers. The film thickness inspection method includes selecting regions other than the chip regions on the semiconductor substrate, and the film thickness is optically detected by illuminating these regions with light.

6 Claims, 28 Drawing Sheets

FILM INSPECTION METHOD

This application claims the benefit of Application Nos. 09-116534 and 09-270909, filed in Japan on Apr. 18, 1997 and Oct. 3, 1997, respectively, which are hereby incorporated by reference.

BACKGROUND OF THE INVENTION

1. Field of the Invention

The present invention relates a polishing apparatus that polishes an object by causing a relative movement between a polishing body and the polishing object while causing the polishing object to contact the polishing body, and specifically concerns a polishing apparatus that is capable of detecting an endpoint of polishing of the polishing object.

The present invention also relates to a film thickness inspection method used in semiconductor processes, and specifically relates to a film thickness inspection method that is suitable for use in film thickness measurement and control in polishing processes.

2. Discussion of the Related Art

In recent years, as a result of an increased degree of integration, semiconductor integrated circuits have utilized both increasingly narrow line widths formed by using a lithography, or similar process, and an increase in the number of laminated layers. As the line-widths have narrowed, the light source wavelengths used in photolithography have become shorter, resulting in a larger numerical aperture ("NA"). Furthermore, the surface shapes of the semiconductor devices are no longer always flat, creating additional problems and additional concerns.

The presence of step differences on the surfaces of semiconductor devices leads to step breaks in wiring and local increases in resistance, thus causing wiring breaks and drops in current capacity. These problems are further compounded where layers are laminated on top of previously patterned layers, projections, and indentations. The patterns in the lower layers are reflected in the surface shapes of the overlying layers, so that steps are created in the surfaces of the upper layers. When wiring layers are laminated on top of layers with such steps, breaks in the wiring layer or local increases in resistance may occur. Where insulating layers are formed on top of layers that have steps, the over-voltage performance of such insulating layers deteriorates and voltage leakage may occur. Moreover, in cases where exposure by photolithography is attempted on layers that have steps on their surfaces, the optical focusing system of the exposure apparatus cannot be focused in the step areas. The occurrence of such defects caused by the steps becomes more conspicuous as the number of layers that are laminated increases.

Accordingly, one proposal has been to remove surface steps by applying polishing processes to the surfaces of the upper layers where further layers are laminated on top of patterned layers. A polishing apparatus of the type shown in FIGS. 16A and 16B has been proposed to remove the surface steps. The apparatus uses a technique known as "chemical mechanical polishing" or "chemical mechanical planarization" (hereafter referred to as "CMP"). This technique is based on polishing of silicon wafers technology. Specifically, in this apparatus, a polishing cloth 1602 (including one or two layers) is pasted to the surface of a rotationally driven base plate 1601, which has a high rigidity, while a wafer 1604 is held in a holder 1603. The wafer 1604 then contacts the surface of the polishing cloth 1602. While the base plate 1601 is rotationally driven, the holder 1603 rotates in the same direction as the base plate 1601 while a load is applied to the holder 1603 from above. A polishing agent 1606, such as acids or alkalies, is then discharged onto the polishing cloth 1602 from a polishing agent discharge port 1605 so that the polishing agent 1606 is applied to the polished surface and the wafer 1604 is polished to a flat surface.

Various techniques are used by various processes during the manufacture of semiconductor devices, with the final state of the flattening polishing varying according to the process involved. For example, in wafer 1604, as shown in FIGS. 17A–D, shallow grooves 1705 used for element separation (shallow trench isolation) are formed in a substrate 1704 and the grooves 1705 are mainly filled with an oxide film filler material 1706, as shown in FIG. 17B. The filler material 1706 is removed by polishing, and the flattening polishing is completed when the undersurface 1707 is exposed in areas other than the grooves 1705, as shown in FIG. 17C.

In the so-called "Damascene" process, as shown in FIG. 18, the grooves 1805, which serve as wiring areas, are formed by etching an insulating film 1804 on the surface of a substrate 1704, as shown in FIG. 18A. A metal wiring material 1806, such as aluminum or copper, is embedded in the grooves 1805, as shown in FIG. 18B. The metal wiring material 1806 is then removed by polishing, and the flattening polishing is completed when the insulating film 1804 in areas other than the wiring areas of the grooves 1805 is exposed, as shown in FIG. 18C. Although it is not shown in the figures, the polishing apparatus is also used in the flattening polishing processes that are performed after the inter-wiring connections (called "through-holes" or "via holes") are filled with a conductive material, such as polysilicon, tungsten, aluminum, or a similar material. The flattening polishing process is completed when the insulating film is exposed.

Conventionally, endpoint detection has been accomplished by a system in which the torque of the motor (not shown in the figures) driving the base plate 1601 is monitored. Specifically, as polishing of the waver 1604 progresses, the characteristics of the polished surface changes, so that the torque required in order to drive the base plate 1601 also changes. For example, if the current supplied to the motor driving the base plate 1601 is monitored at a fixed voltage, the endpoint of the flattening polishing process can be detected from the fluctuation of the current.

The change in torque will be described with reference to FIGS. 17A–17D and 20. For example, when the filler material 1706 is polished so that the surface is flattened, as shown in FIGS. 17A–17D, the torque becomes approximately constant as indicated by portion P of the characteristic curve, as shown in FIG. 20, so that fluctuation is reduced. As the surface is further polished, the filler material 1706 is removed from areas other than the grooves 1705 so that polishing is completed. The undersurface 1707 is thus exposed resulting in-changed surface conditions. As a result, the torque becomes approximately constant at a lower torque level as indicated by portion Q of the characteristic curve, as shown in FIG. 20. The difference between the torque levels associated with the different materials makes it is possible to detect the endpoint of the polishing process.

Generally, the occupation rate of the grooves 1705 (i.e., the proportion of the area occupied by the grooves 1705 at the surface of the wafer 1604) is small. The filler material 1706 and undersurface 1707, in areas other than the grooves 1705, have different coefficients of kinetic friction. Thus, the amount of fluctuation in the torque is large, so that the endpoint of the polishing process can be detected relatively easily. However, the proportion of the area occupied by the grooves 1705 is not always small; furthermore, the filler material 1706 and the undersurface 1707 do not always have different coefficients of kinetic friction. If the occupation rate is large, or the filler material 1706 and the undersurface 1707 have approximately the same coefficient of kinetic friction, the amount of fluctuation in the torque is small even when the polishing process is completed. Therefore, precise endpoint detection is diminished and depending on the conditions the detection of the endpoint, detection of completion of the flattening polishing process becomes difficult. A similar problem occurs in the flattening process shown in FIGS. 18A–18C.

Additionally, there are flattening processes wherein the surface steps in the outermost surface layers of the substrates are removed by CMP, and it is necessary to measure the film thickness of the outermost surface layers in order to determine whether the outermost surface layers have been polished to the desired film thickness. This process is employed because there is no change in the surface shape or surface characteristics, and hence there is no corresponding change in the motor torque as the materials change due the polishing process when the process is completed. Therefore, it is virtually impossible to detect the endpoint using the torque detection method. Such a process is shown in FIGS. 19A and B.

In this process, wiring 1904 is formed on the surface of a substrate 1704, as shown in FIG. 19A, and the wiring 1904 is covered by an inter-layer insulating film 1905 as shown in FIG. 19B. The surface of the inter-layer insulating film 1905 is then flattened by polishing and the flattening polishing is completed when the inter-layer insulating film 1905 thickness over the wiring 1904 reaches a pre-set value TO.

Another conventional method has been proposed for detecting the film thickness, wherein the film thickness is measured using light interference by illuminating the outermost surface layer with light and detecting the reflected light. Specifically, the endpoint is detected by forming slits in the base plate and polishing cloth, illuminating the polished surface of the wafer via the slits with a laser beam from a laser beam light source installed beneath the base plate, and detecting the reflected light with an interferometer.

Unfortunately, the light measuring interference method described above creates further complications. For instance, although the light interference detection method may solve the film thickness measurement problem, the same endpoint detection region should always be detected. However, the wafer 1604 and base plate are rotating, and thus it is difficult to detect the same endpoint detection region in all cases.

Furthermore, the substrates, wherein CMP process is employed, have circuit patterns formed on the underlying layers resulting in a non-uniform light reflectivity of the underlying layers. Accordingly, even if the outermost surface layer is illuminated with light in order to measure the film thickness, the distribution of the reflectivity of the underlying layers effects the results, so that the film thickness cannot be accurately measured.

SUMMARY OF THE INVENTION

Accordingly, the present invention is directed to a film thickness polishing apparatus and inspection method that substantially obviates one or more of the problems due to limitations and disadvantages of the related art.

An object of the present invention is to provide a film thickness inspection method that makes it possible to measure precisely the film thickness of the uppermost layer on a semiconductor substrate which has circuit patterns formed on the underlying layers.

Specifically, the present invention provides a film thickness inspection method that optically detects the film thickness of the outermost layer on a semiconductor substrate on which desired wiring patterns are formed in predetermined chip regions by laminating a plurality of layers, wherein regions other than the chip regions on the semiconductor substrate are selected, and the film thickness is optically detected by illuminating these regions with light.

Another object of the present invention is to provide a polishing apparatus that makes it possible to detect specified endpoints on the polishing object in all cases, even during polishing and in an in-line configuration.

To achieve these and other advantages and in accordance with the purpose of the present invention, as embodied and broadly described, the polishing apparatus and film inspection method includes a polishing apparatus for polishing an object by causing a relative movement between a polishing body and the polishing object, wherein a polishing agent is interposed between the polishing body and the polishing object, the polishing apparatus includes an optical measuring system capable of measuring at least one of a polished surface of the polishing object or a film thickness of the polishing object, a position detection system capable of detecting relative positions of the optical measuring system and the polishing object; and a control system capable of controlling at least one of the optical measuring system or the polishing object in accordance with signals output from the position detection system so that prescribed endpoint detection regions of the polishing object are measured by the optical measuring system.

In another aspect, the polishing apparatus and film inspection method includes a polishing apparatus for polishing an object by causing a relative movement of a polishing body and the polishing object, wherein a polishing agent is interposed between the polishing body and the polishing object, the polishing apparatus includes an optical measuring system capable of measuring at least one of a polished surface state of the polishing object or a film thickness of the polishing object, a position detection system capable of detecting relative positions of the optical measuring system and the polishing object; and a control system capable of controlling the optical measuring system and the polishing object in accordance with position detection system signals so that prescribed endpoint detection regions of the polishing object are measured by the optical measuring system.

In a further aspect, the polishing apparatus and film inspection method includes a polishing apparatus for polishing an object by causing a relative movement of a polishing body and the polishing object, wherein a polishing agent is interposed between the polishing body and the polishing object, the polishing apparatus includes an optical measuring system capable of measuring a polished surface state of the polishing object and a film thickness of the polishing object, a position detection system capable of detecting relative positions of the optical measuring system and the polishing object; and a control system capable of controlling at lest one of the optical measuring system or the polishing object in accordance with position detection system signals so that prescribed endpoint detection regions of the polishing object are measured by the optical measuring system.

In a still further aspect, the polishing apparatus and film inspection method includes a polishing apparatus for polishing an object by causing a relative movement of a polishing body and the polishing object, wherein a polishing agent is interposed between the polishing body and the polishing object, the polishing apparatus includes an optical measuring system capable of measuring a polished surface state of the polishing object and a film thickness of the polishing object, a position detection system capable of detecting relative positions of the optical measuring system and the polishing object; and a control system capable of controlling the optical measuring system and the polishing object in accordance with position detection system signals so that prescribed endpoint detection regions of the polishing object are measured by the optical measuring system.

In an additional aspect, the polishing apparatus and film inspection method includes a film thickness inspection method that optically detects a film thickness of an outermost layer of a semiconductor substrate upon which wiring patterns are formed in predetermined chip regions, the film thickness inspection method including the steps of selecting non-chip regions on the semiconductor substrate, and optically detecting the film thickness of the outermost layer of the semiconductor substrate by illuminating the non-chip regions with light.

In a still further aspect, the polishing apparatus and film inspection method includes a film thickness inspection method including the steps of polishing an outermost layer of a semiconductor substrate, the semiconductor substrate includes wiring patterns formed thereon in predetermined chip regions, contacting the outermost layer of the semiconductor substrate to a base plate and rotating the base plate, illuminating the outermost layer of the semiconductor substrate with light through a window formed in a surface of the base plate while the polishing is being performed, detecting reflected light, selecting a detection signal produced from the reflected light when a non-chip region of the semiconductor substrate passes over the window formed in the base plate, and determining a film thickness of the outermost layer of the semiconductor substrate from the selected detection signal.

In another aspect, the polishing apparatus and film inspection method includes a film thickness inspection method including the steps of polishing an outermost layer on a semiconductor substrate, wherein the semiconductor substrate includes wiring patterns formed in predetermined chip regions and wherein polishing is accomplished by causing the outermost layer of the semiconductor substrate to contact a rotating base plate, illuminating the outermost layer of the semiconductor substrate during polishing when a non-chip region of the semiconductor substrate passes over the window formed in the base plate, detecting light reflected from the non-chip regions; and determining a film thickness of the outermost layer of the semiconductor substrate.

In a final aspect, the polishing apparatus and film inspection method includes a polishing apparatus for polishing a semiconductor substrate, the polishing apparatus including a base plate capable of polishing a semiconductor substrate, wherein a window is formed in a surface of the base plate and is used to illuminate an outermost layer of the semiconductor substrate, a holder capable of holding the semiconductor substrate on the base plate, a driving device capable of rotating the base plate, a polishing agent dispenser capable of dispensing a polishing agent to a surface of the base plate, and a film thickness optical detection system that is capable of detecting a film thickness of the outermost layer of the semiconductor substrate that is being polished.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
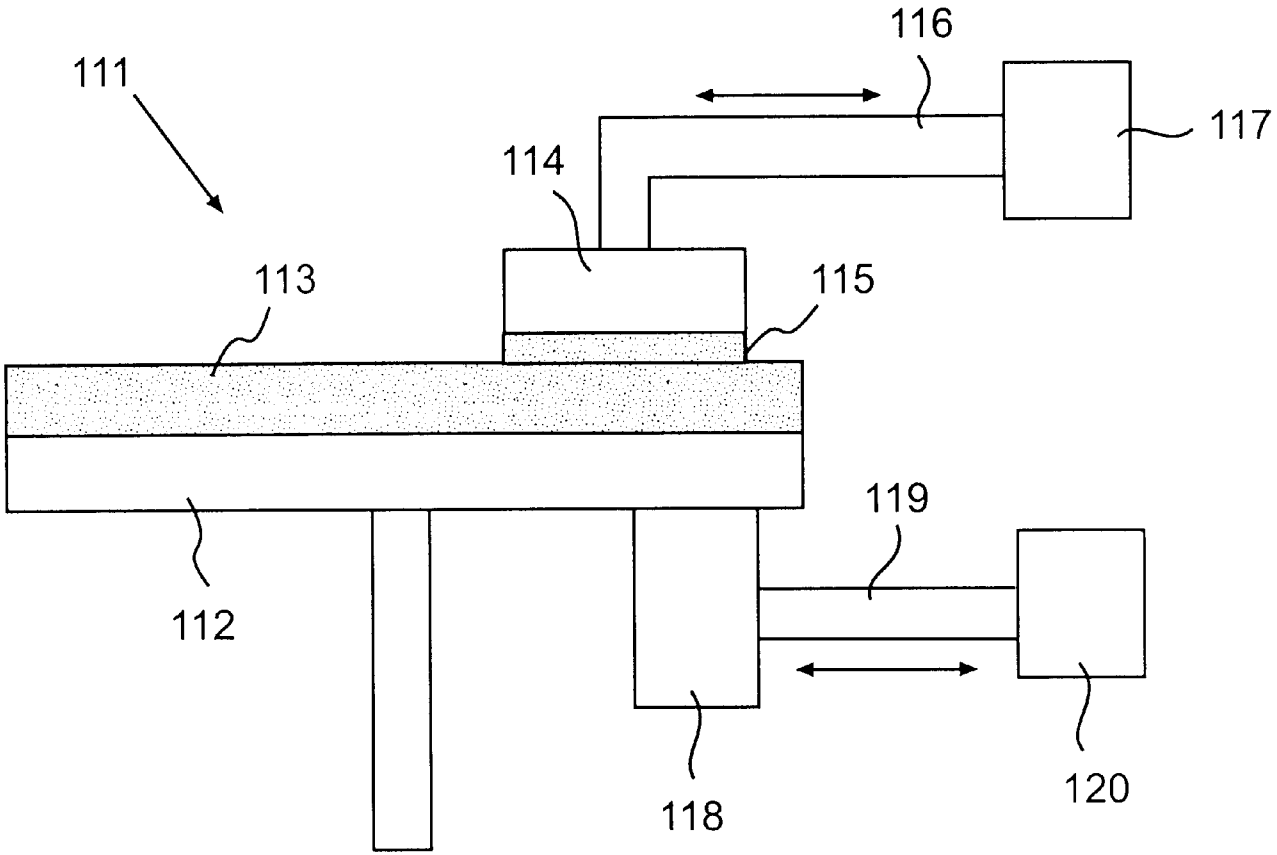
FIG. 1 is a schematic front view of a polishing apparatus of a first embodiment of the present invention.

FIG. 1 is a schematic front view of a polishing apparatus of a first embodiment of the present invention. In FIG. 1, a polishing apparatus 111 uses a chemical mechanical polishing (CMP) technique. In the polishing apparatus 111, a polishing pad 113 used as a "polishing member" is formed on the surface of a rotationally driven base plate 112. A wafer 115, which is the "polishing object," is held in a holder 114.

The holder 114 is supported by a holder supporting arm 116 and is connected to a first driving device 117 so that the holder 114 is rotationally driven by the first driving device 117. The holder 114 is concurrently set so that the holder 114 is capable of parallel movement (hereafter referred to as "swinging") in the direction indicated by the arrows in FIG. 1.

Although not shown in the figures, a polishing agent is discharged onto the polishing pad 113 from a polishing agent nozzle during polishing.

On the underside of the base plate 112 (i.e., the opposite side from the side on which the wafer 115 is disposed), an endpoint detection device 118 is supported by an endpoint detection device supporting arm 119. The endpoint detection device 118 is connected to a second driving device 120 via the supporting arm 119, and is set so that the endpoint detection device 118 is capable of performing parallel movement (in the direction indicated by the arrows in FIG. 1) by the second driving device 120.

Figure 2:
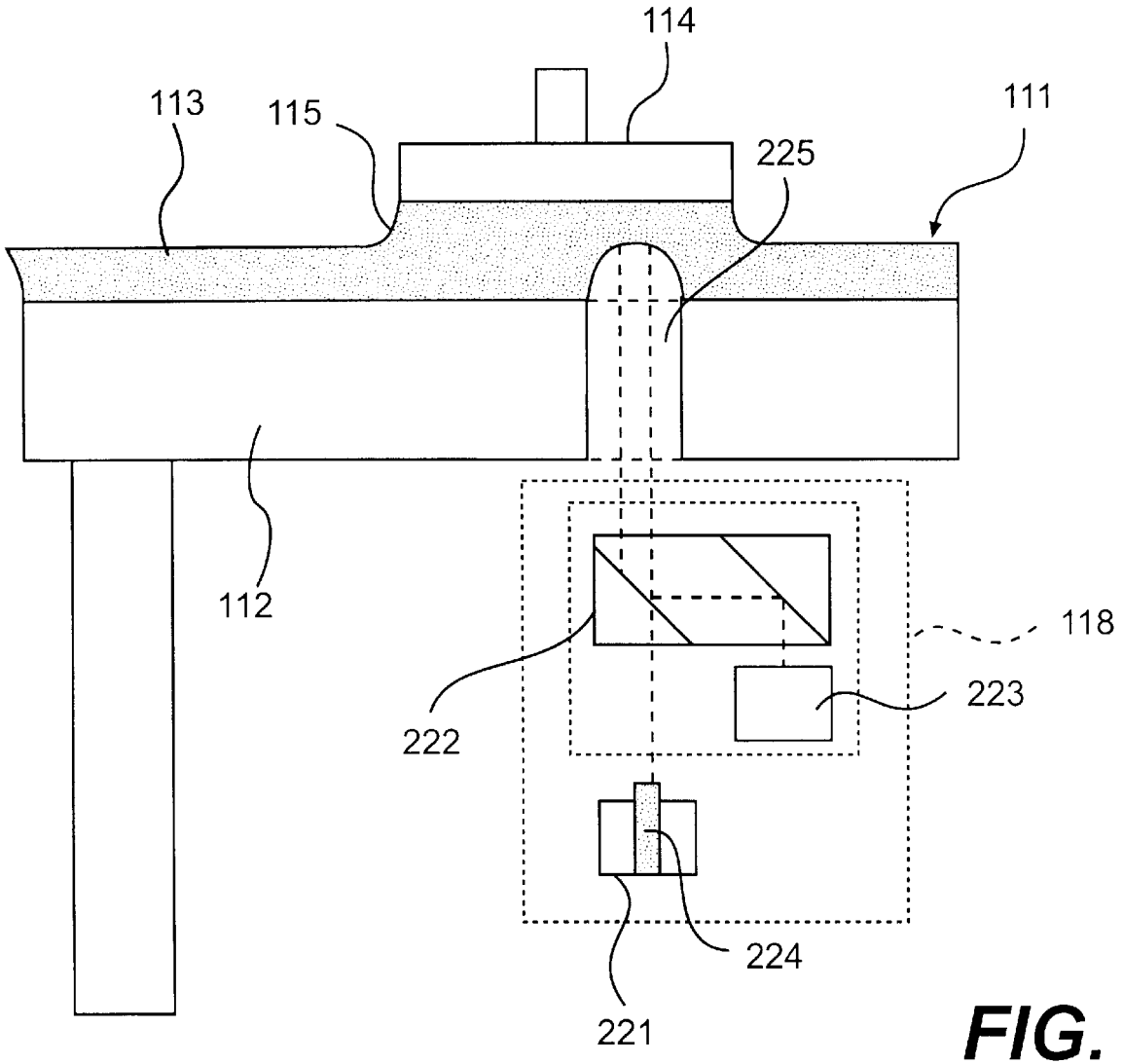
FIG. 2 is a schematic diagram illustrating additional components of the polishing apparatus of the first embodiment of the present invention.

As shown in FIG. 2, an imaging device 221 images the polished surface of the wafer 115, and is installed in the endpoint detection device 118. A wafer surface measuring device 223 (used as an "optical measuring system") optically measures the polished state of the polished surface of the wafer 115 or the film thickness on the wafer 115 via an optical system 222, and a light-emitting device 224 illuminates the polished surface of the wafer 115. By adjusting the optical system 222, the surface conditions or film thickness at any desired position in the vicinity of the optical axis of the imaging device 221 can be measured by the wafer surface measuring device 223.

FIG. 2 is a schematic diagram illustrating additional components of the polishing apparatus of the first embodiment of the present invention. As is shown in FIG. 2, a detection window 225, which exhibits light-transmitting characteristics, is formed in portions of the base plate 112 and polishing pad 113. Imaging of the polished surface of the wafer 115 by means of the imaging device 221 and measurement of the polished state or film thickness by means of the wafer surface measuring device 223 can be performed via the detection window 225. The "polishing body," which is an element of the present invention, includes the base plate 112 and polishing pad 113.

Figure 5:
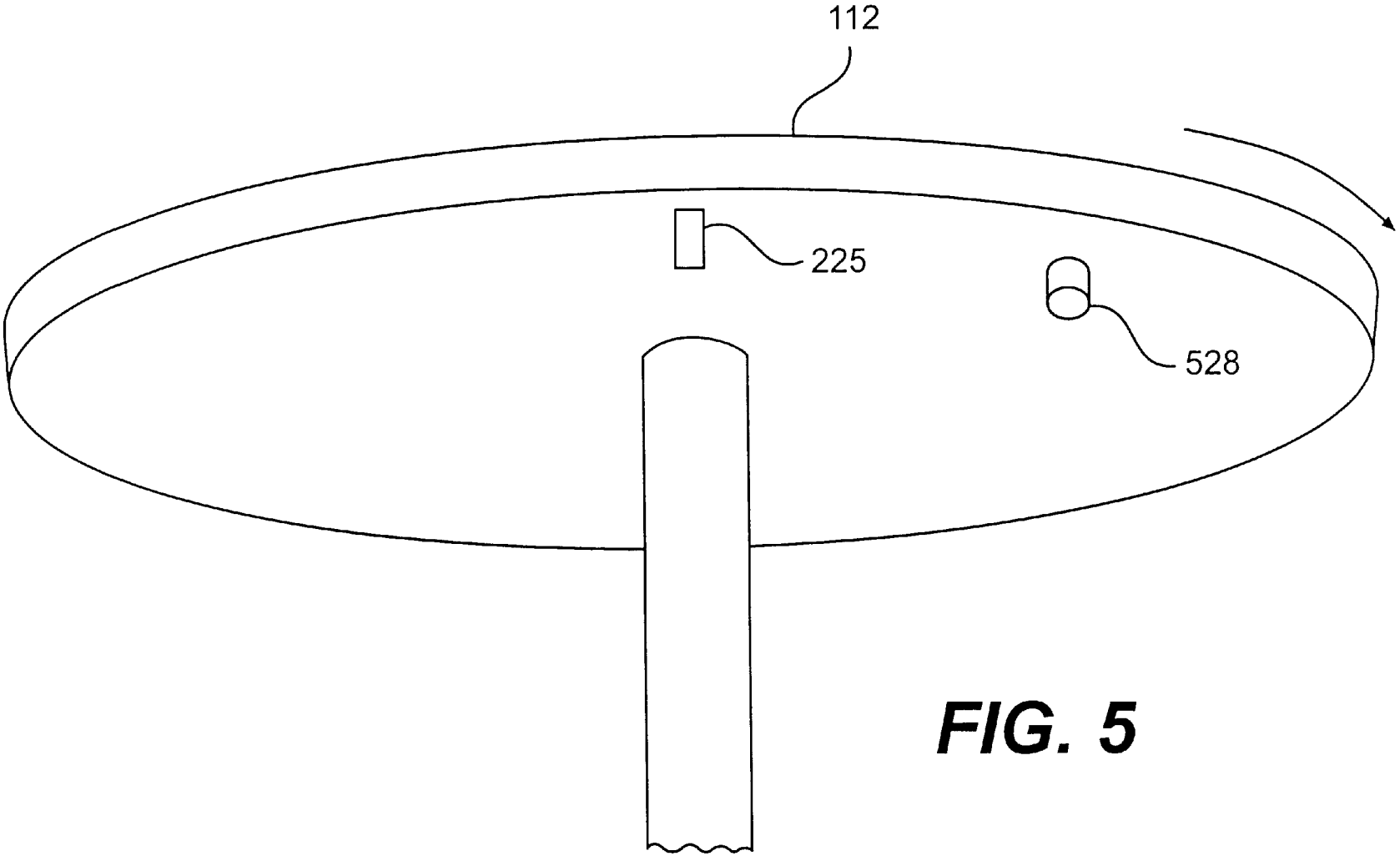
FIG. 5 is a perspective view showing the undersurface of the base plate in the first embodiment of the present invention.

FIG. 5 is a perspective view showing the undersurface of the base plate in the first embodiment of the present invention. As is shown in FIG. 5, a light-emitting element 528 is installed on the undersurface of the base plate 112 at a point preceding the detection window 225. The system is arranged so that the imaging device 221 is triggered by detecting the light emitted by the light-emitting element 528 during the rotation of the base plate 112, thus causing a light pulse to be emitted when the detection window 225 coincides with the position of the endpoint detection device 118.

Figure 4A:
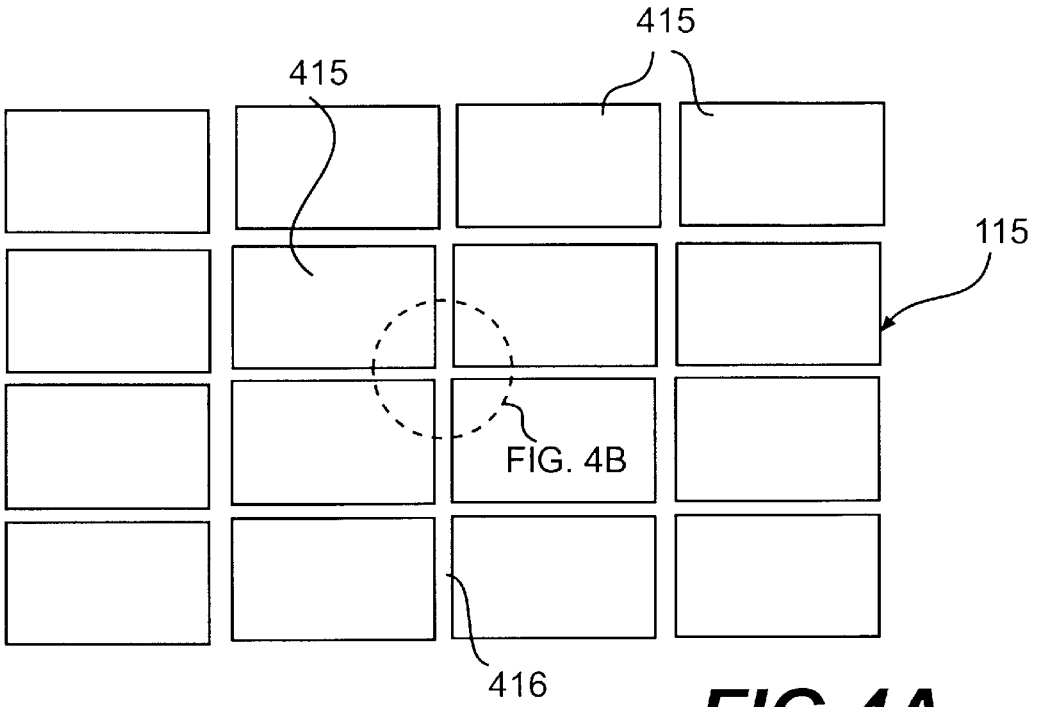
FIG. 4A is a diagram illustrating a wafer used as the polishing object in the first embodiment of the present invention.
Figure 4B:
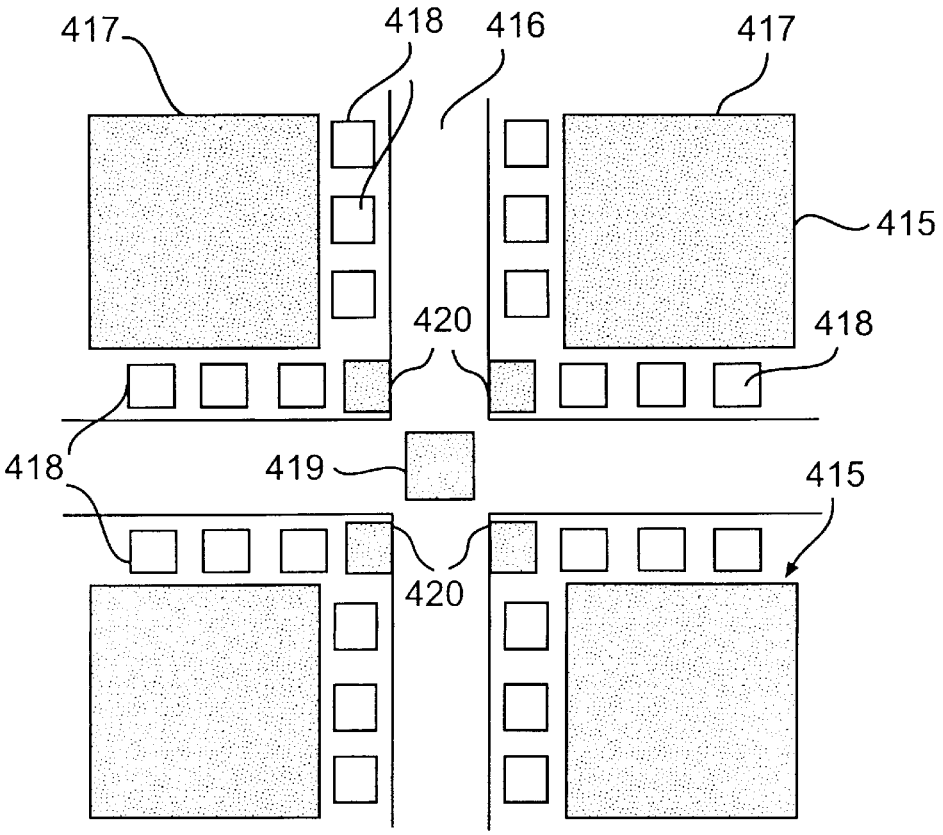
FIG. 4B is an enlarged view of a portion of the wafer illustrated in FIG. 4A.

FIG. 4A is a diagram illustrating a wafer used as the polishing object in the first embodiment of the present invention and FIG. 4B is an enlarged view of a portion of the wafer illustrated in FIG. 4A. In FIG. 4A, the wafer 115 has numerous chips 415 formed by the interposition of scribe lines 416 cut into the wafer 115.

As shown in FIG. 4B, in each of the chips 415 a plurality of bonding pads 418 are formed to the outside of a device active region 417. Endpoint detection comer regions 419, which have a size of approximately 50 microns square, are formed on the corner parts which are non-active regions outside the device active region 417.

Furthermore, the scribe lines 416 (also called "wafer slits") have a width of approximately 70 to 100 microns.

Alignment marks are formed in these areas (although this is not shown in the figures), and endpoint detection center region 420, which have a size of approximately 50 microns square, can be formed in the centers of the areas where the longitudinal and lateral scribe lines 416 intersect.

Figure 6:
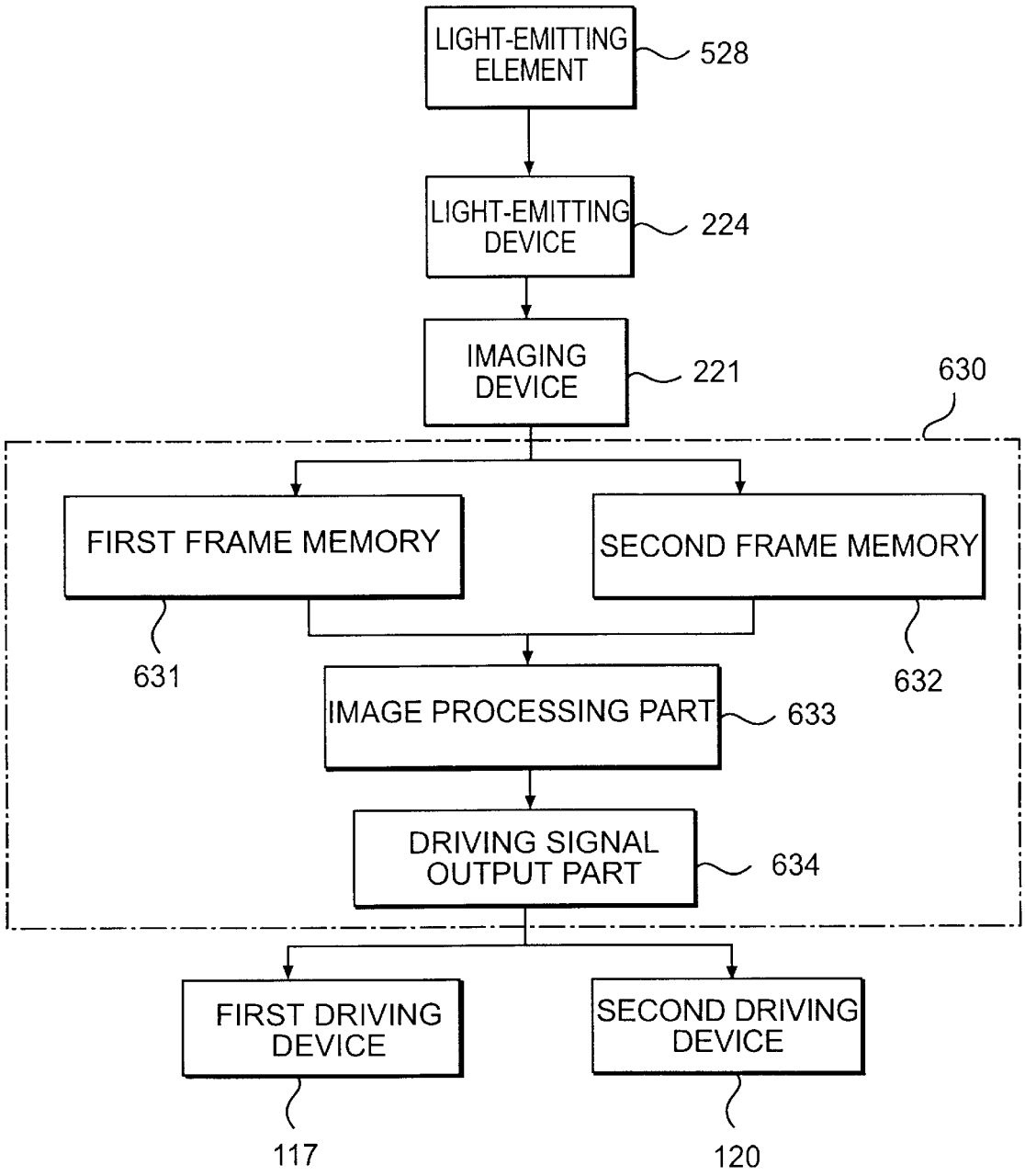
FIG. 6 is a flow chart that illustrates the endpoint detection operation of the first embodiment of the present invention.

FIG. 6 is a flow chart that illustrates the endpoint detection operation of the first embodiment of the present invention. As is shown in FIG. 6, the imaging device 221 is connected to a central processing unit 630, and the central processing unit 630 is connected to first and second driving devices 117 and 120, so that the first and second driving devices 117 and 120 are controlled by signals from the imaging device 221.

Specifically, an image of the polished surface of the wafer 115 is stored in a first frame memory 630, and the image and an immediately preceding image stored in a second frame memory 631 are compared by the extraction of characteristic features of the pattern by an image processing unit 632. While the relative positional relationship between the endpoint detection device 118 and the polished surface of the wafer 115 is determined, signals are sent to the first and second driving devices 117 and 120 from a driving signal output unit 633. Positional alignment of the endpoint detection device 118 is performed.

In regard to the positional alignment operation, positioning of the endpoint detection regions 419 and 420 may be performed directly from the image data. Alternatively, processing in two steps is also possible with the positional alignment of the characteristic pattern of the wafer 115 in the vicinity of the endpoint detection regions 419 and 420 being performed in the first step, and the positional alignment of the endpoint detection regions 419 and 420 being performed in the second step. For example, noting the scribe lines 416 of the characteristic pattern used in the first step, the pattern of the corner portions of the chips 415 is cruciform. Thus, pattern recognition is easy and there is little recognition error. Accordingly, the positional alignment precision of the endpoint detection regions 419 and 420 in the second step is improved.

Position alignment is required in applications where the wafer 115 moves across the base plate 112 by a swinging movement. The positional alignment is also necessary where the wafer 115 shifts inside the holder 114 during polishing.

Figure 3:
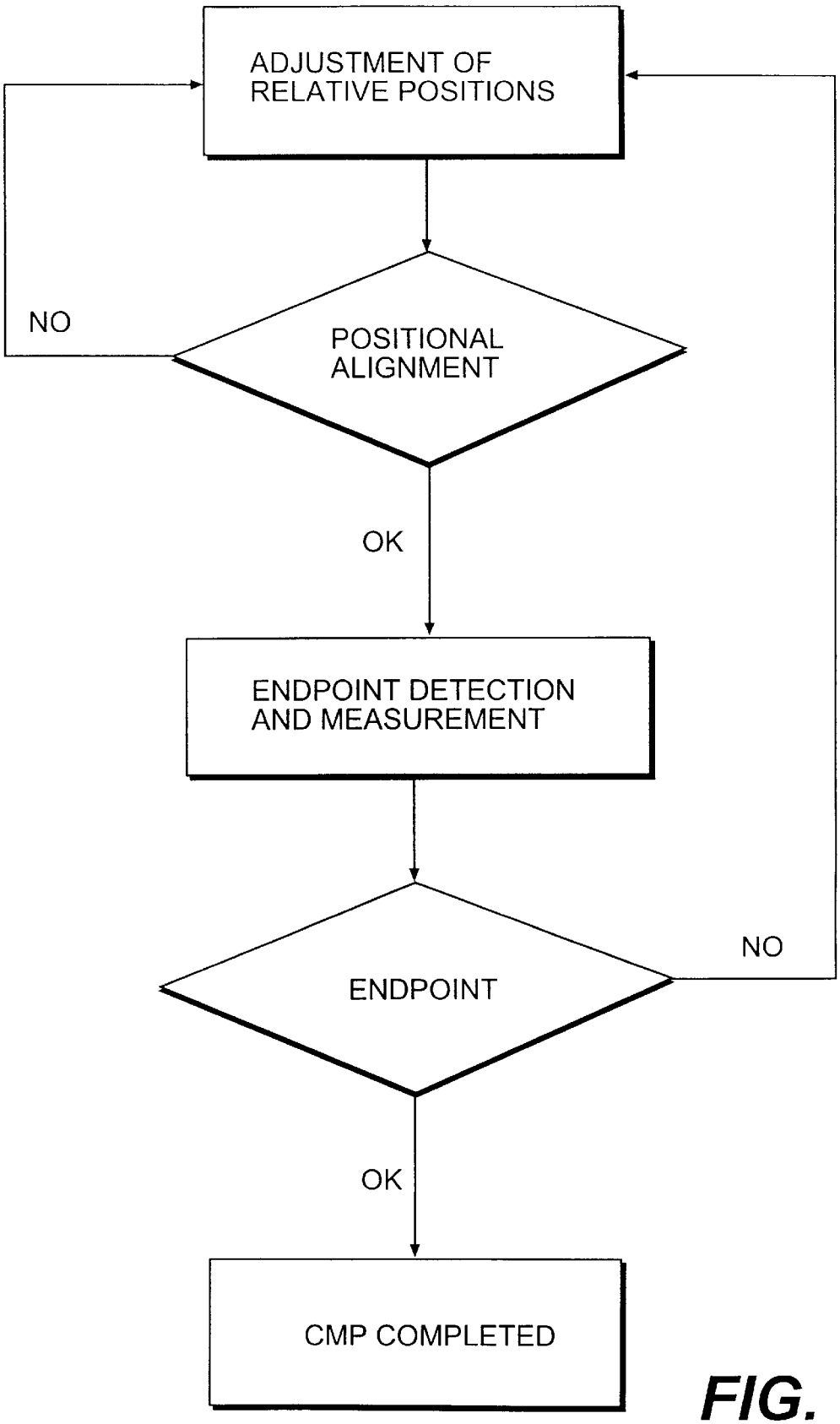
FIG. 3 is a flow chart of the polishing process of the first embodiment of the present invention.

When the positional alignment is completed, the conditions or film thickness of the polished surface of the wafer 115 is measured by the wafer surface measuring device 223 via the detection window 225 using the endpoint detection regions 419 and 420, and the completion of the flattening process is ascertained. FIG. 3 shows a flow chart of the series of the process steps.

Figure 19A:
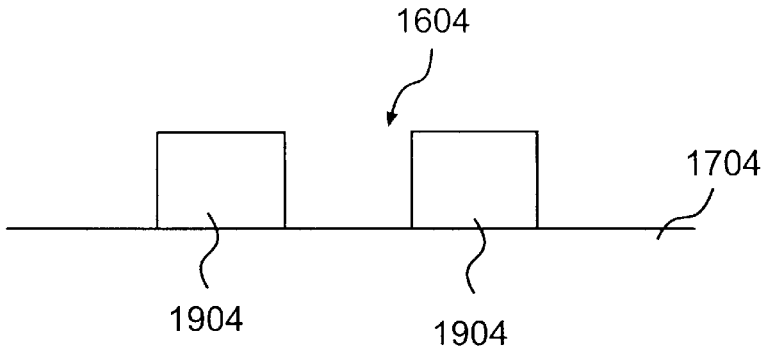
FIGS. 19A–19C are explanatory diagrams that illustrates a third conventional technique of manufacturing a semiconductor device.
Figure 19B:
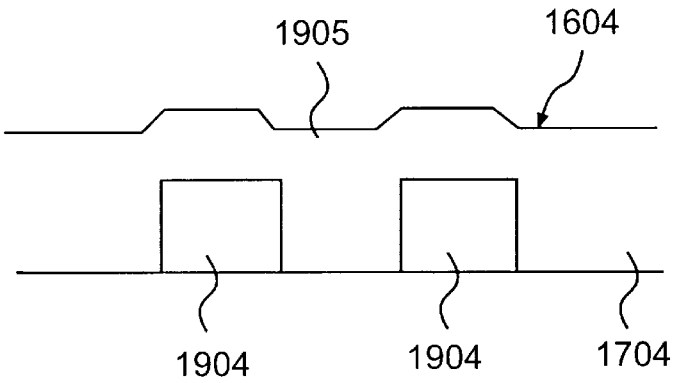
Figure 19C:
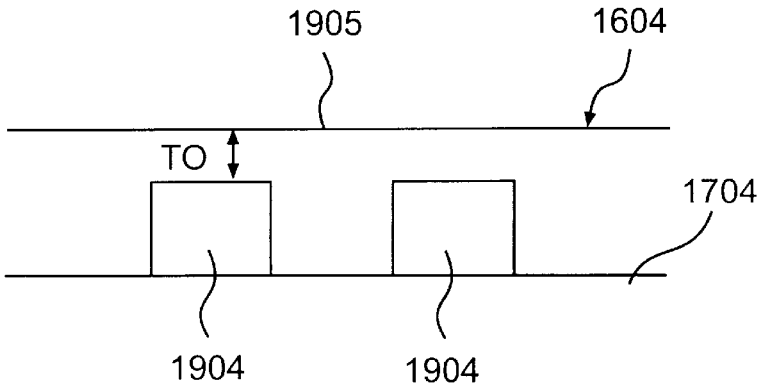
Figure 20:
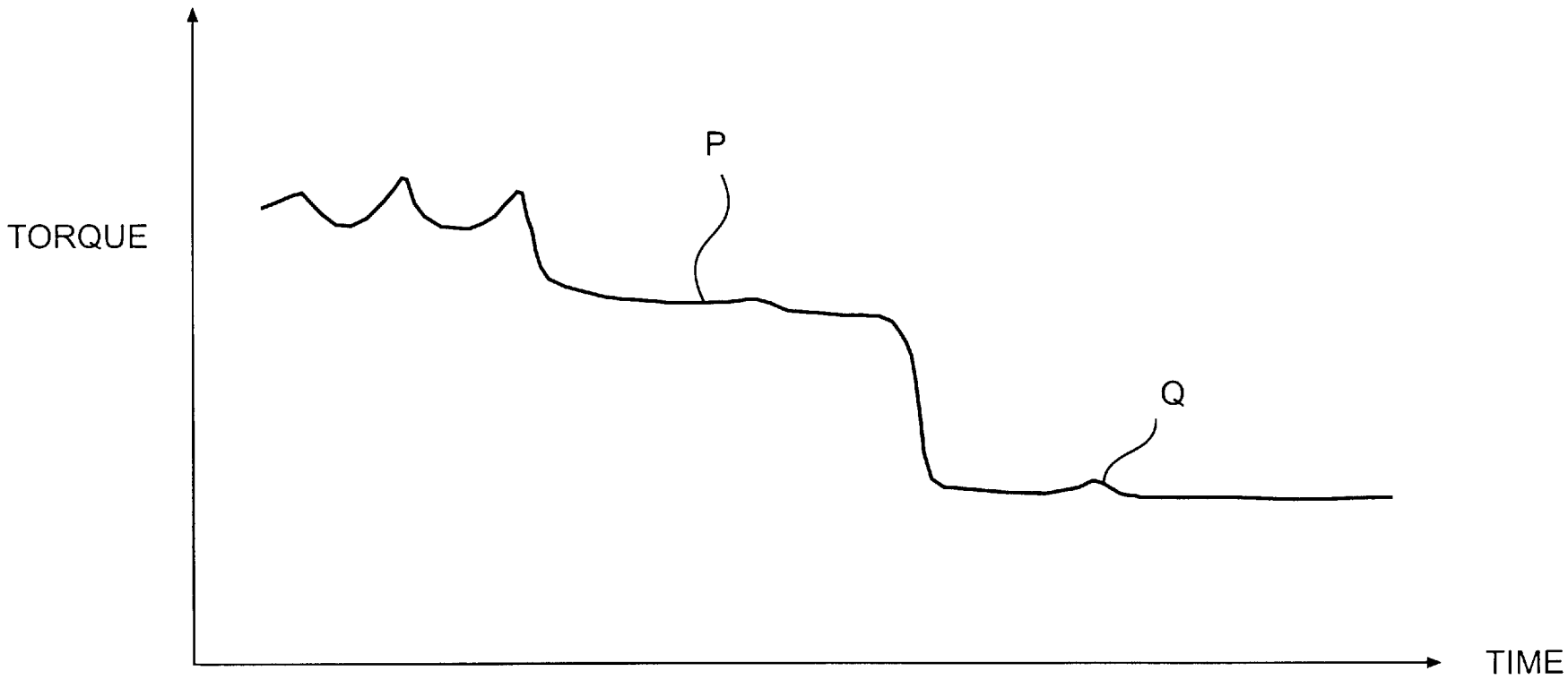
FIG. 20 is a graph that shows the change in torque over time while the wafer is being conventionally polished.

FIGS. 17A–19C are explanatory diagrams that illustrate conventional techniques of manufacturing a semiconductor device. In the wafer surface measuring device 223, the physical quantity that is measured can be appropriately selected in accordance with the type of flattening process involved. For example, in the case of the flattening process of the present embodiments being applied to the semiconductor device, as shown in FIGS. 17A–17D, the file thickness is selected as the quantity to be measured and the endpoint can be detected by measuring the film thickness of the filler material 1706. Furthermore, in the case of the flattening process being applied to the damascene wiring process for manufacturing a semiconductor device, as shown in FIGS. 18A–18C, the reflectivity is selected as the measuring parameter and the endpoint can be detected based on the changes in the reflectivity by measuring the reflectivity from the metal wiring material 1806. Moreover, in the case of the flattening process of the present embodiments being applied to an inter-layer insulating film 1905, as shown in FIG. 19, (which presents difficulties of detection in a torque detection method), if the film thickness of the inter-layer insulating film 1905 is measured in the present embodiment, polishing can be completed when a prescribed film thickness is reached.

Thus, since the endpoints are detected by the wafer surface measuring device 223 with the positions of the endpoint detection regions 419 and 420 and the position of the endpoint detection device 118 aligned, appropriate position detection of fixed points can always be accomplished.

Looking at FIG. 2, first, the distance moved during the exposure time by the image of the polished surface of the wafer 115 focused on the surface of the image sensor of the imaging device 221 when the endpoint detection device 118 is at rest is calculated.

V (cm/s) is the relative velocity between the wafer 115 and the endpoint detection device 118, t (s) is the exposure time of the image sensor, k is the optical system magnification of the imaging device 221, r (cm) is the distance of the observation position of the imaging device 221 from the center of rotation of the holder 114, and R (rpm) is the rotational speed of the holder 114. The distance L (cm) moved by the image of the polished surface of the wafer 115 on the surface of the image sensor during exposure can be expressed as follows:

$$L=k\times V\times t=k\times 2\pi rR/60\times t$$

Where the respective values of the variables are k=10, r=10 cm, R=40 rpm, and the exposure time is set at $t=1/10000$s, using the electronic shutter function of the image sensor, the following result is obtained:

$$L=10\times 2\pi 10\times 40/60\times 1/10000=0.0419\ \text{cm}\approx 420\ \mu\text{m}$$

Accordingly, the equation reveals that when a comparison is made with the dimensions of the endpoint detection regions 419 and 420, the distance L moved by the image is such that a substantially static image cannot be obtained. Even if the observation position is set at r=10 cm, which reduces the relative velocity V, situations still arise wherein the distance L increases. For instance, portions of endpoint detection regions 419 and 420 are observed that are located towards the outer circumference of the wafer, thereby increasing the distance L moved by the image. Furthermore, as the size of the wafer 115 increases the value of L also increases.

By accurately performing positional alignment of the prescribed endpoint detection regions 419 and 420, the distance L moved by the image is minimized and a precise image of the polished surface of the wafer 115 is inputted, thus improving the precision of endpoint detection.

Since the magnification k cannot be appreciably changed, the above equation reveals that it is necessary to shorten the exposure time t or lower the relative velocity V in order to minimize the distance L moved by the image. However, if an electronic shutter function is being employed, a time of approximately $t=1/10000$s=i.e., 100 microseconds, is the limit. Accordingly, in the present embodiment, a light-emitting device 224, such as a pulsed laser, is installed in the endpoint detection device 118 and the exposure time is shortened so that the flow of the image is suppressed.

If the pulsed light is emitted for an interval of t=1 microsecond in synchronization with the detection window 225, the distance moved by the image can be reduced by two orders of magnitude, resulting in a value of L=4 microns. Therefore, a substantially static image can be obtained.

FIG. 2 shows that the detection window 225 is installed in the base plate 112 and polishing pad 113, sacrificing uniformity of polishing. The size and number of such windows needs to be set so that the windows have no effect. In the present embodiment, considering the size of the imaging region on the polished surface of the wafer 115, it is sufficient if the width of the detection windows 225 in the direction of rotation is approximately 1 cm. This size window has no effect on the polishing characteristics, and causes no problems. Furthermore, in regard to the length of the detection windows 225 in the radial direction and the positions and number of detection windows in the base plate 112, a greater length and a larger number of detection windows 225 broadens the range in which endpoint detection within the wafer 115 can be accomplished even if the holder 114 swings. However, it is necessary to set the length and number of detection windows so that there is no effect on the uniformity of polishing.

Looking at FIGS. 4A and 4B, the scribe lines 416 or the corner portions of the chips 415 are suitable for use as the endpoint detection regions 419 and 420. Specifically, if a flat location with no underlying pattern is selected as a region for measuring the optical film thickness, film thickness calculations can be performed on the basis of a simple optical model, so that calculated data can be converted into a film thickness value easily and with good precision. However, in cases where a pattern is formed underneath a selected region the film thickness is not uniform in the step areas, and the analysis of the measured data is complicated. There is an increased possibility that an accurate film thickness value will not be determined. If the film thickness or the surface conditions of the polished surface are measured by detecting reflected light, little scattering occurs if a flat portion is selected so that a signal with little noise can be obtained. Taking these facts into consideration the scribe lines ordinarily contain no patterns other than special patterns, e.g., alignment marks or special elements, used for checking so-called test element groups, or TEG. Therefore, such scribe lines constitute flat areas and are appropriate for use as the endpoint detection regions 420. Furthermore, the corner portions of the chips 415 ordinarily contain no patterns, constitute flat areas, and are suitable for use as the endpoint detection regions 419. In other words, as long as the endpoint detection regions are flat, either of the two types of regions may be used. From the standpoint of using characteristic extraction by image processing to specify the location, the scribe lines 416 show a cruciform pattern in the vicinity of the corner portions of the chips 415. In such locations, a series of processing steps from characteristic extraction to positional alignment can easily be performed. Thus, the cruciform intersection areas and the corner portions of the chips 415 are suitable for use as the endpoint detection regions 419 and 420.

Second Embodiment

Figure 7:
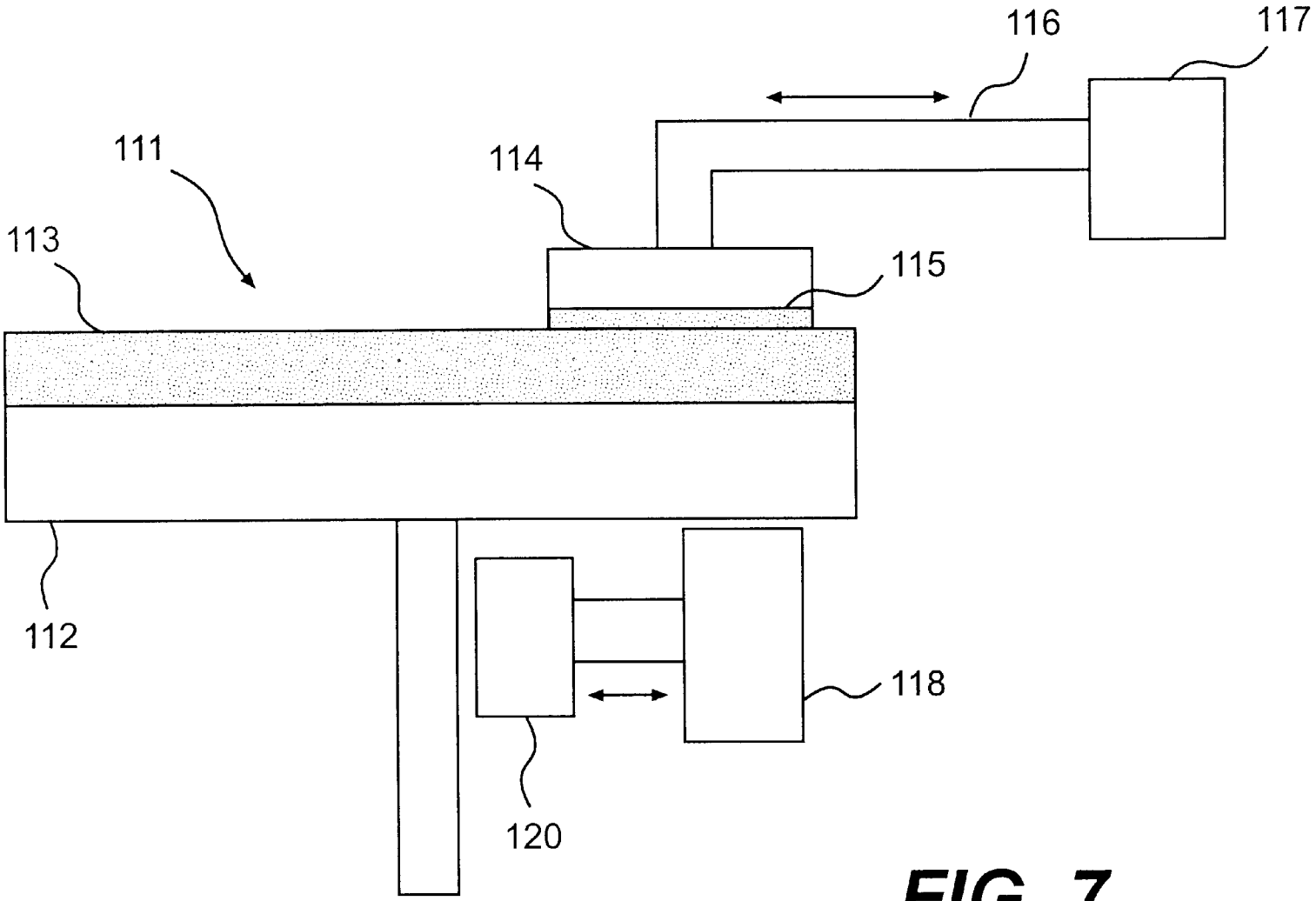
FIG. 7 is a schematic front view of a polishing apparatus of a second embodiment of the present invention.
Figure 8:
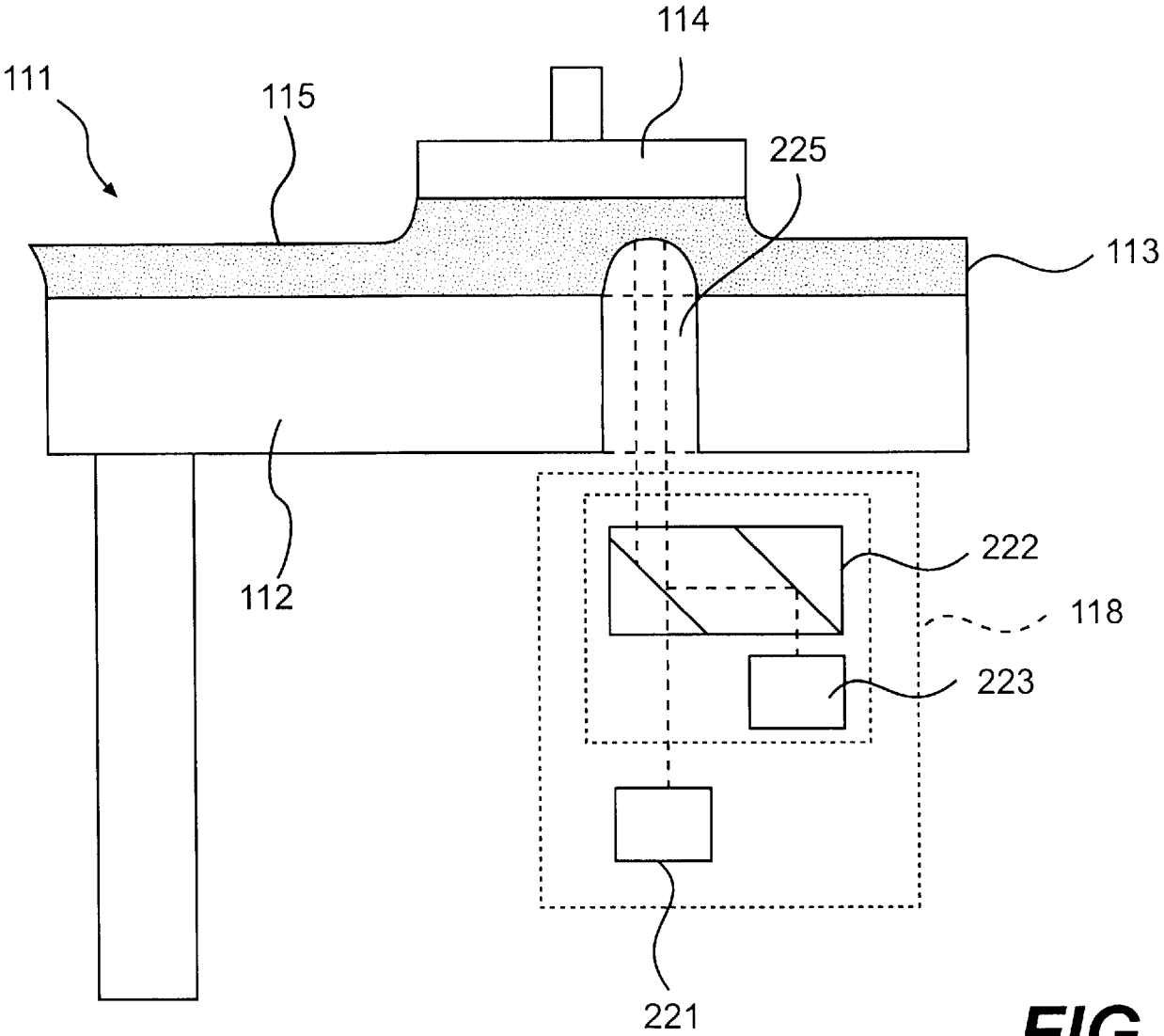
FIG. 8 is a schematic diagram illustrating additional components of the polishing apparatus the second embodiment of the present invention.

The second embodiment of the present invention, as illustrated in FIGS. 7 and 8 will now be described in detail.

FIG. 7 is a schematic front view of a polishing apparatus of a second embodiment of the present invention and FIG. 8 is a schematic diagram illustrating additional components of the polishing apparatus the second embodiment.

The second embodiment of the present invention is arranged so that the endpoint detection device 118 is moves in a parallel movement as indicated by the arrows in FIG. 7, and is also rotationally driven by the second driving device 120.

The first and second driving devices 117 and 120 are then driven and controlled by the central processing unit 630 so that the endpoint detection device 118 is moved in a parallel direction and rotationally driven in synchronization with the swinging of the holder 114.

As a result of such synchronization, the relative velocity V between the endpoint detection device 118 and the wafer 115 is reduced to an extremely small value so that the distance L moved by the image of the polished surface of the wafer 115 is small, thus making it possible to obtain a precise image with no image flow.

In regard to the rotational driving of the endpoint detection device 118, there is no need to induce a 360-degree rotation at all times. Imaging of the polished surface and endpoint detection can be accomplished by applying a trigger through the detection of the light from the light-emitting element 528 so that the endpoint detection device 118 rotates in the form of a circular arc in synchronization with the detection windows 225 and wafer 115 only when the detection windows 225 passes the wafer 115.

By lowering the relative velocity between the detection windows 225 and the wafer 115, the time per revolution of the base plate 112 increases during which image and endpoint detection and measurement can be performed. The positional alignment precision and precision of endpoint detection is thus improved.

The base plate 112 and the holder 114 are ordinarily rotate in the same direction in order to insure the uniformity of polishing within the wafer 115. Accordingly, the detection windows 225 may be set in positions further to the outside than the center of rotation of the wafer 115 in order to lower the relative velocity between the detection windows 225 and the wafer 115.

The width of the detection windows 225 in the direction of rotation can be calculated as shown below. The position of each detection window 225 is expressed in terms of the distance from the center of rotation of the base plate 112 and the distance r from the center of rotation of the holder 114. Furthermore, if the rotational speeds of the base plate 112 and holder 114 are set at the same value, then ideally polishing non-uniformity within the wafer 115 is eliminated. Accordingly, during polishing the rotational speeds of the two parts are set at approximately equal values, so that when the respective rotational speeds of the base plate 112, wafer 115 and endpoint detection device 118 is set at R, the detection window 225 and the endpoint detection device 118 are separated by a distance of $2\pi(a-r)R/60\times t$ (cm) at time t (s) following coincidence.

If a=20 (cm), r=10 (cm) and R=40 (cm), then after a time of $t=1/60$s, which is the standard frame read-out time of the image sensor, the detection window 225 and the endpoint detection device 118 are shifted relative to each other by a distance of $2\pi\times(20-10)\times40/60\times1/60=0.7$ cm.

Taking into consideration the size of the imaging region, the width of the detection windows 225 is approximately 1.5 to 2 cm. With a detection window 225 within approximately 1.5 to 2 cm, there is no effect on the polishing characteristics.

Furthermore, in this embodiment, no light-emitting device 224 of the type used in the first embodiment is employed. However, it is possible to use a construction in which a light-emitting device that illuminates the polished surface of the wafer 115 is added in order to improve the S/N ratio of the images in the imaging device 221.

Third Embodiment

Figure 9A:
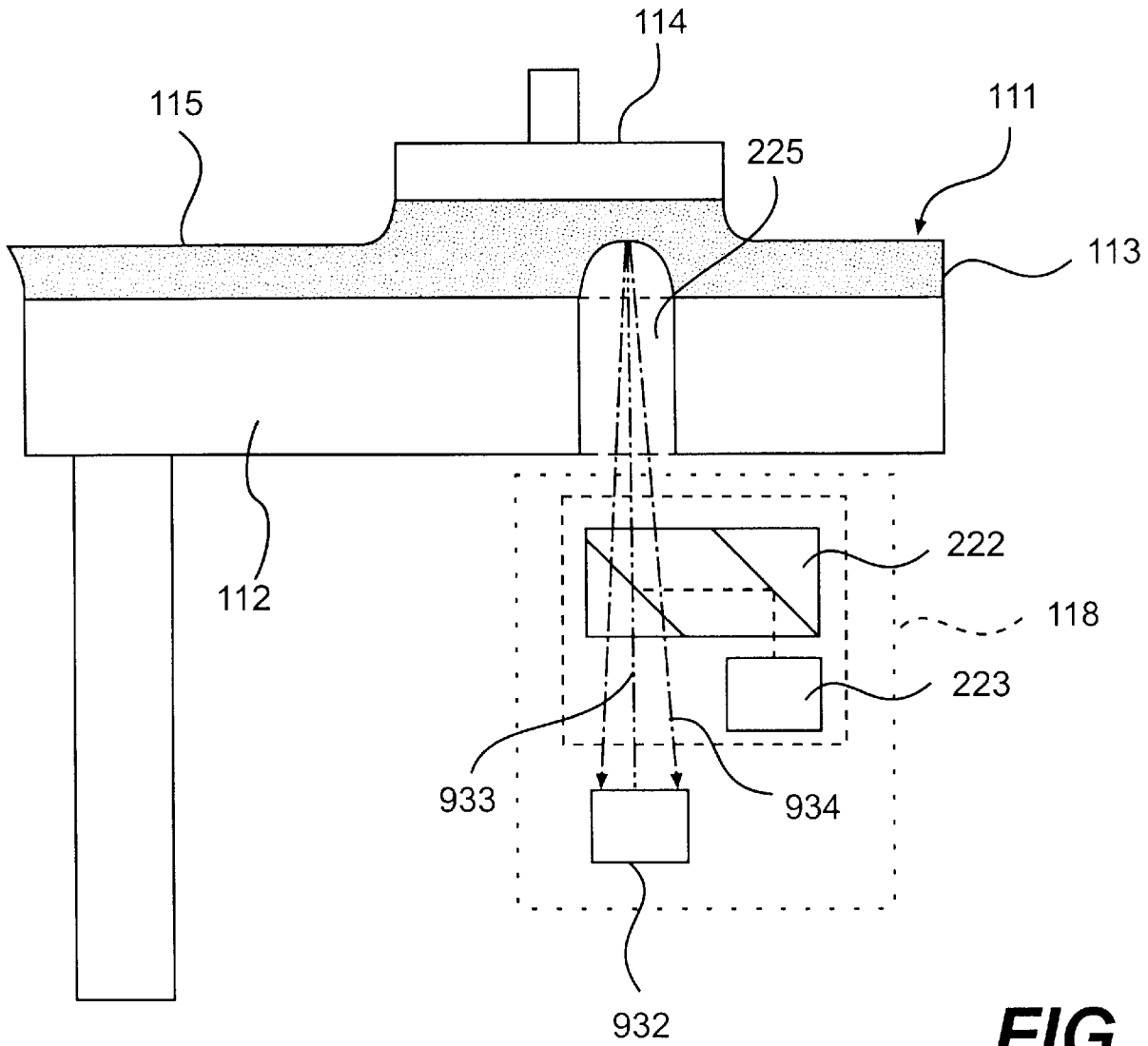
FIG. 9A is a schematic diagram illustrating components of a polishing apparatus of a third embodiment of the present invention.
Figure 9B:
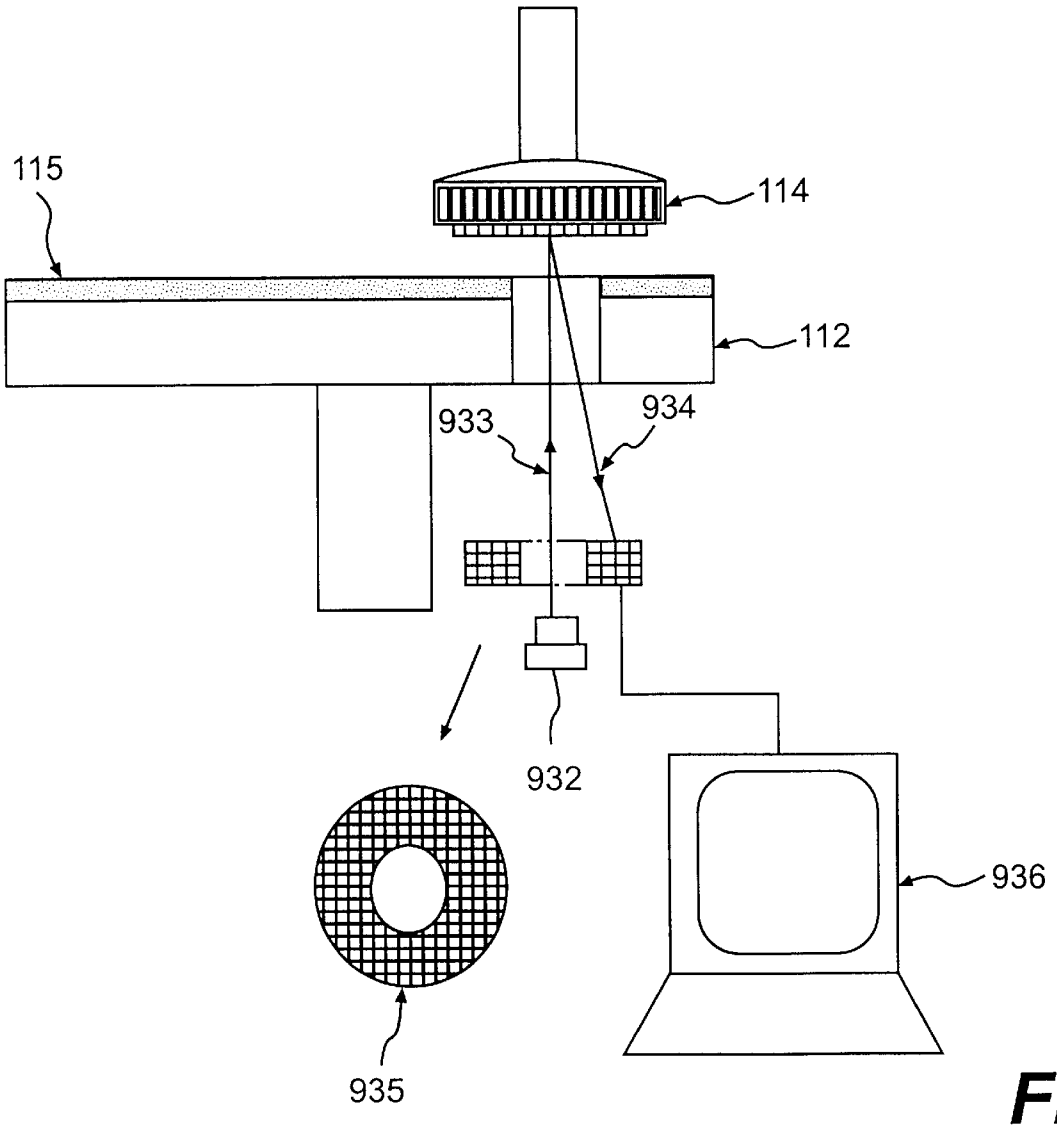
FIG. 9B is a schematic diagram illustrating a doughnut shaped light-receiving component and additional components of a polishing apparatus of the third embodiment of the present invention.
Figure 10A:
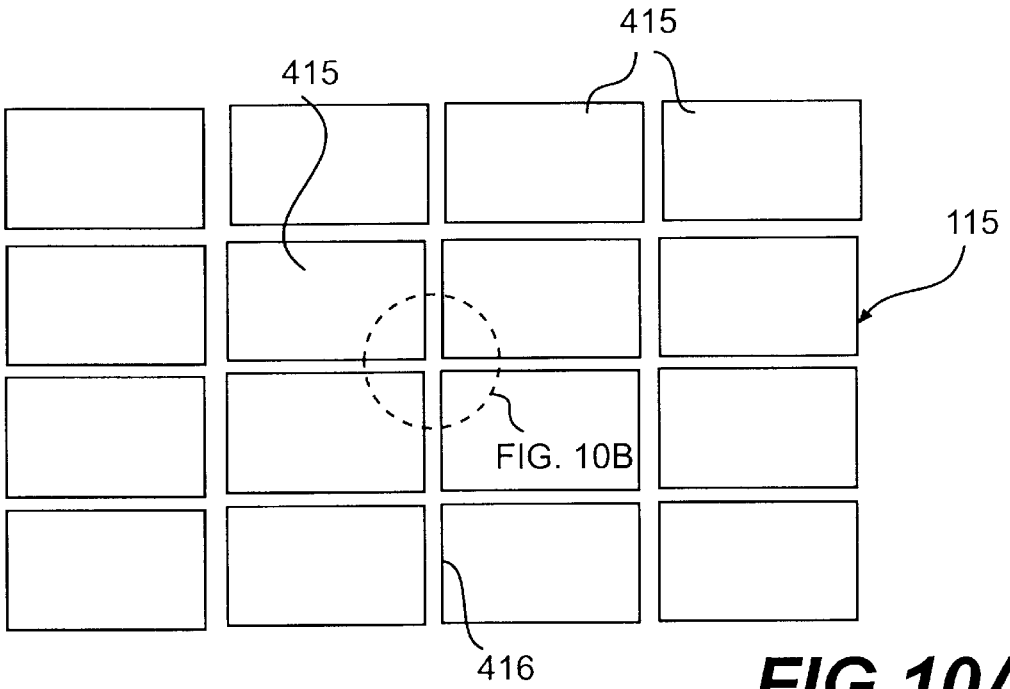
FIG. 10A is a diagram illustrating a wafer used as the polishing object of the third embodiment of the present invention.
Figure 10B:
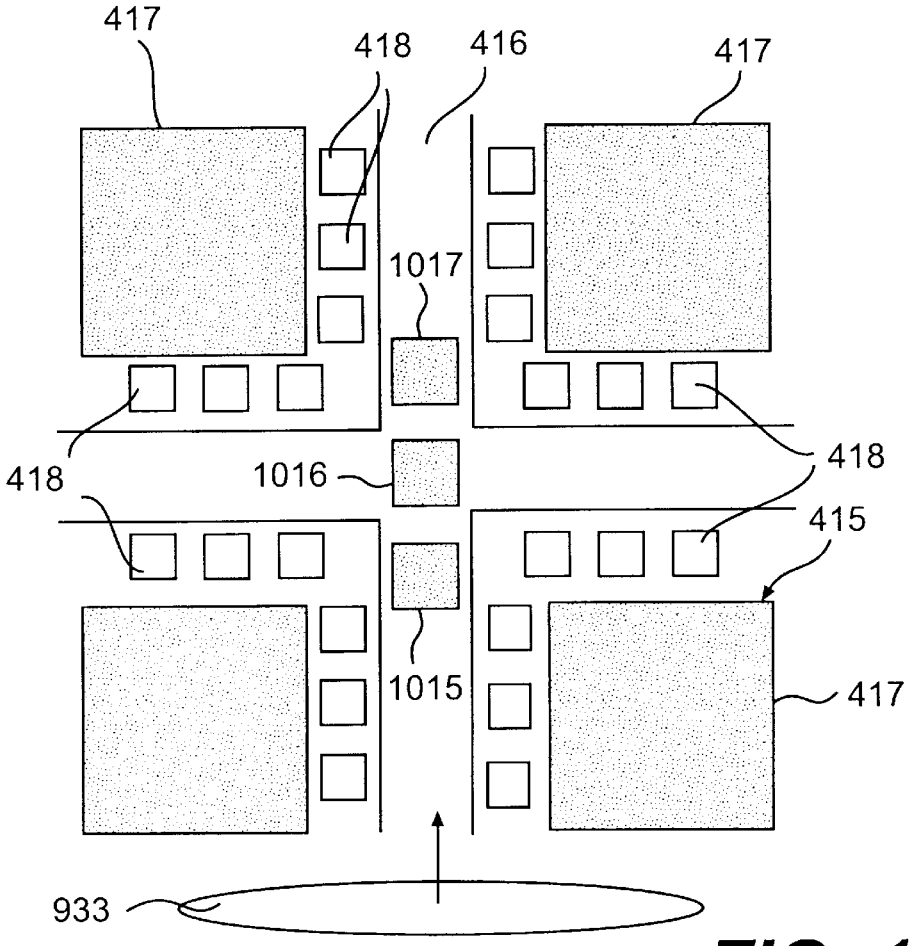
FIG. 10B is an enlarged view of a portion of the wafer illustrated in FIG. 10A.
Figure 11:
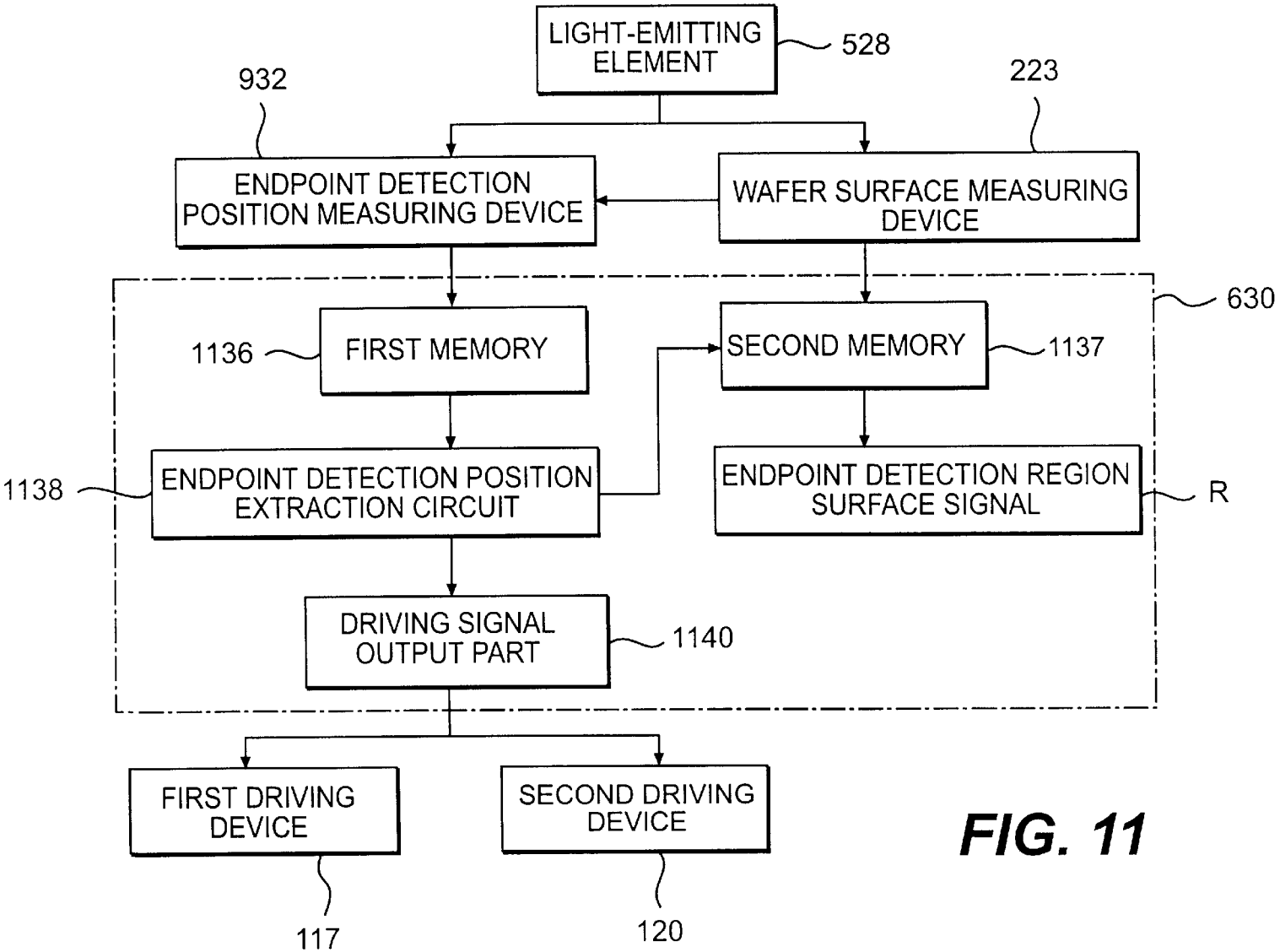
FIG. 11 is a flow chart that illustrates the endpoint detection operation of the third embodiment of the present invention.
Figure 12:
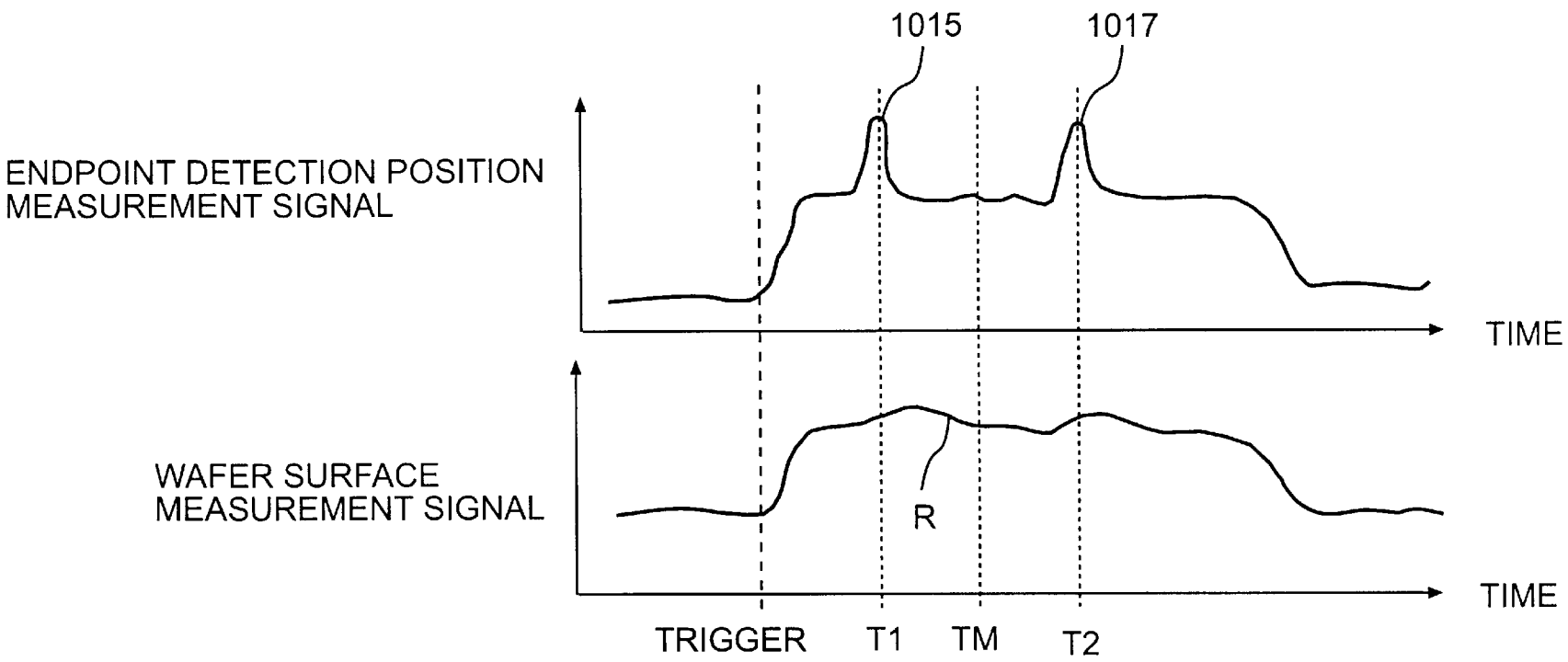
FIG. 12 is a graph that shows the relationship between the endpoint detection position measurement signal output and the wafer surface measurement signal output of the third embodiment of the present invention.

The third embodiment of the present invention, as illustrated in FIGS. 9 through 12 will now be described in detail. FIGS. 9A and 9B are schematic diagrams illustrating additional components of a polishing apparatus of a third embodiment of the present invention. FIG. 10A is a diagram illustrating a wafer used as the polishing object of the third embodiment and FIG. 10B is an enlarged view of a portion of the wafer illustrated in FIG. 10A. FIG. 11 is a flow chart that illustrates the endpoint detection operation of the third embodiment. FIG. 12 is a graph that shows the relationship between the endpoint detection position measurement signal output and the wafer surface measurement signal output of the third embodiment.

In the third embodiment of the invention shown in FIGS. 9A and 9B, an endpoint detection position measuring device 932 is used as a "position detection system" in the endpoint detection device 118. The endpoint detection position measuring device 932, as shown in FIGS. 9A and 9B, is arranged so that the monochromatic probe light 933 from a monochromatic light source is emitted toward the wafer 115. Thus, light signals from a pair of endpoint detection position marks 1015 and 1017 (shown in FIG. 10B) formed at prescribed positions on the surface of the wafer 115 are detected by a detector and outputted to monitor 936. Furthermore, the optical axis of the endpoint detection position measuring device 932 coincides with the optical axis of the wafer surface measuring device 223.

The endpoint detection position marks 1015 and 1017 consist of diffraction gratings and are formed on the scribe lines 416 of the wafer 115. Endpoint detection regions 1016 are formed at the intersection points between the endpoint position detection marks 1015 and 1017. The endpoint detection regions 1016 may also be formed as diffraction gratings. In regard to the positions where the endpoint detection regions 1016 are formed, the regions 1016 may be formed in any flat area, e.g., in the corner portions of the chips 415.

In the present embodiment, the relative velocity between the endpoint detection device 118 and the wafer 115 is controlled by means of the first and second driving devices 117 and 120. The monochromatic probe light 933 emitted from the endpoint detection position measuring device 932 scans the surface of the wafer 115 at a constant speed. When the monochromatic probe light 933 is directed onto the endpoint detection position marks 1015 and 1017, first-order diffracted light 934 is generated.

If the monochromatic probe light 933 is substantially perpendicularly incident, the nth-order diffracted light is diffracted in a direction of $d \times \sin \theta = n \times \lambda$ and first-order diffracted light 934 is diffracted in a direction separated by a distance of $b \times \tan \theta$ from the optical axis in the endpoint detection device 118, where d (cm) is a diffraction grating pitch of the endpoint detection position marks 1015 and 1017, $\lambda$ (cm) is the wavelength of the monochromatic probe light 933, and b (cm) is the distance from the surface of the wafer 115 to the endpoint detection device 118. Accordingly, in the endpoint detection position measuring device 932, the first-order diffracted light 934 alone can be selectively detected by a detector that has a doughnut-shaped light-receiving portion 935, as shown in FIG. 9B, so that the endpoint detection position mark 1015 can be specified.

The approximate radius of the doughnut-shaped light-receiving portion 935 can be expressed as $$b \times \tan \theta = 10 \times \tan(\sin-1(633E-75E-4)) = 1.28 \text{ cm}$$

where $$d = 5E-4 \text{ (cm)}, \theta = 633E-7 \text{ (cm)}, \text{ and } b = 10 \text{ (cm)}.$$

In this embodiment, the relative velocities of the wafer 115, detection windows 225, and endpoint detection device 118 can be adjusted by means of the first and second driving devices 117 and 120, so that both the speed and the range of the scanning of the monochromatic probe light 933 across the endpoint detection regions 1016 on the surface of the wafer 115 can be set. Furthermore, a smaller relative velocity between the endpoint detection device 118 and the detection windows 225 allows a reduction in the size of the detection windows 225. However, as is shown in FIG. 9, a space that allows the passage of the first-order diffracted light 934 from the endpoint position detection marks 1015 and 1017 must be formed in the detection windows 225.

The surface signals from the endpoint detection regions 1016, as is shown in FIG. 10B, are detected when light from a light-emitting element 528, installed at a prescribed position on the undersurface of the base plate 112, is detected by the wafer surface measuring device 223 during the rotation of the base plate 112 as shown in FIG. 11. A trigger is activated so that signals from the endpoint detection position measuring device 932 and wafer surface measuring device 223 are respectively stored in the first memory 1136 and second memory 1137 of the central processing unit 630.

As a result, the polished surface of the rotating wafer 115 is illuminated by the monochromatic probe light 933 via the detection windows 225. The first-order diffracted light 934 from the first and second endpoint detection position marks, 1015 and 1017, are detected at the positions at the respective times t1 and t2, as shown in FIG. 12. Since the optical axes of the endpoint detection position measuring device 932 and wafer surface measuring device 223 coincide, the center point in time "tm" of the two beams of first-order diffracted light 934 (i.e., the center point in time "tm" between the respective times t1 and t2) is determined by an endpoint detection position extraction circuit 1138, and the endpoint detection region surface signal R, at this point in time, constitutes the signal from the endpoint detection region 1016.

The time interval of the paired beams of first-order diffracted light 934 varies according to the scanning direction of the monochromatic probe light 933; however, the breadth of this variation is within a certain fixed range. Accordingly, in cases where the time interval of the first-order diffracted light 934 is outside the set range, e.g., where only one of the paired endpoint detection position marks 1015 or 1017 is detected, a relative position correction signal is sent to a driving signal output portion 1139, and the relative positional relationship of the wafer 115 and endpoint detection device 118 is corrected by the first and second driving devices 117 and 120, respectively.

Furthermore, where endpoint detection position marks 1015 and 1017 are deliberately formed on the surface of the wafer 115, as in the present embodiment, first-order diffracted light 934 will not appear in the predetermined direction unless the marks 1015 and 1017 themselves are also formed in flat areas. Accordingly, in the present embodiment, it is desirable that the endpoint detection position marks 1015 and 1017 be formed on the scribe lines 416. If endpoint detection regions 1016 are set between the pair endpoint detection position marks 1015 and 1017, the optimal setting of the endpoint detection regions is in the areas of intersection of the scribe lines 416.

In the present embodiment, no imaging device 221 is contained in the endpoint detection device 118. It is also possible to install an imaging device 221 in the endpoint detection device 118 as in the first and second embodiments and to utilize image processing for the correction of the relative positions. Moreover, diffraction gratings formed on the surface of the wafer 115 are used as the endpoint detection position marks 1015 and 1017. The diffraction gratings used as the alignment marks of the exposure apparatus may also be used as the endpoint detection position marks 1015 and 1017.

Fourth Embodiment

Figure 13:
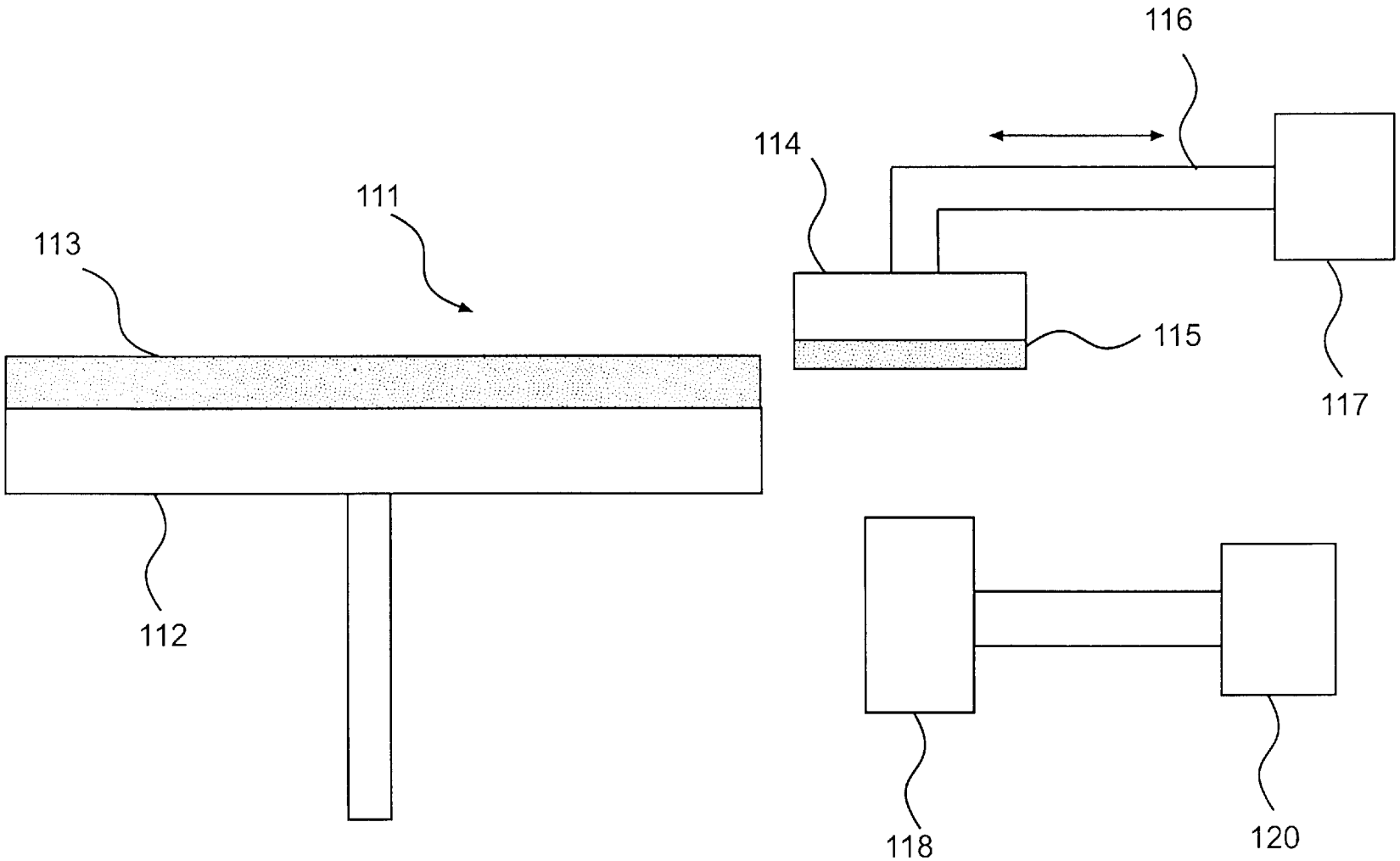
FIG. 13 is a schematic front view of a polishing apparatus of a fourth embodiment of the present invention.
Figure 14:
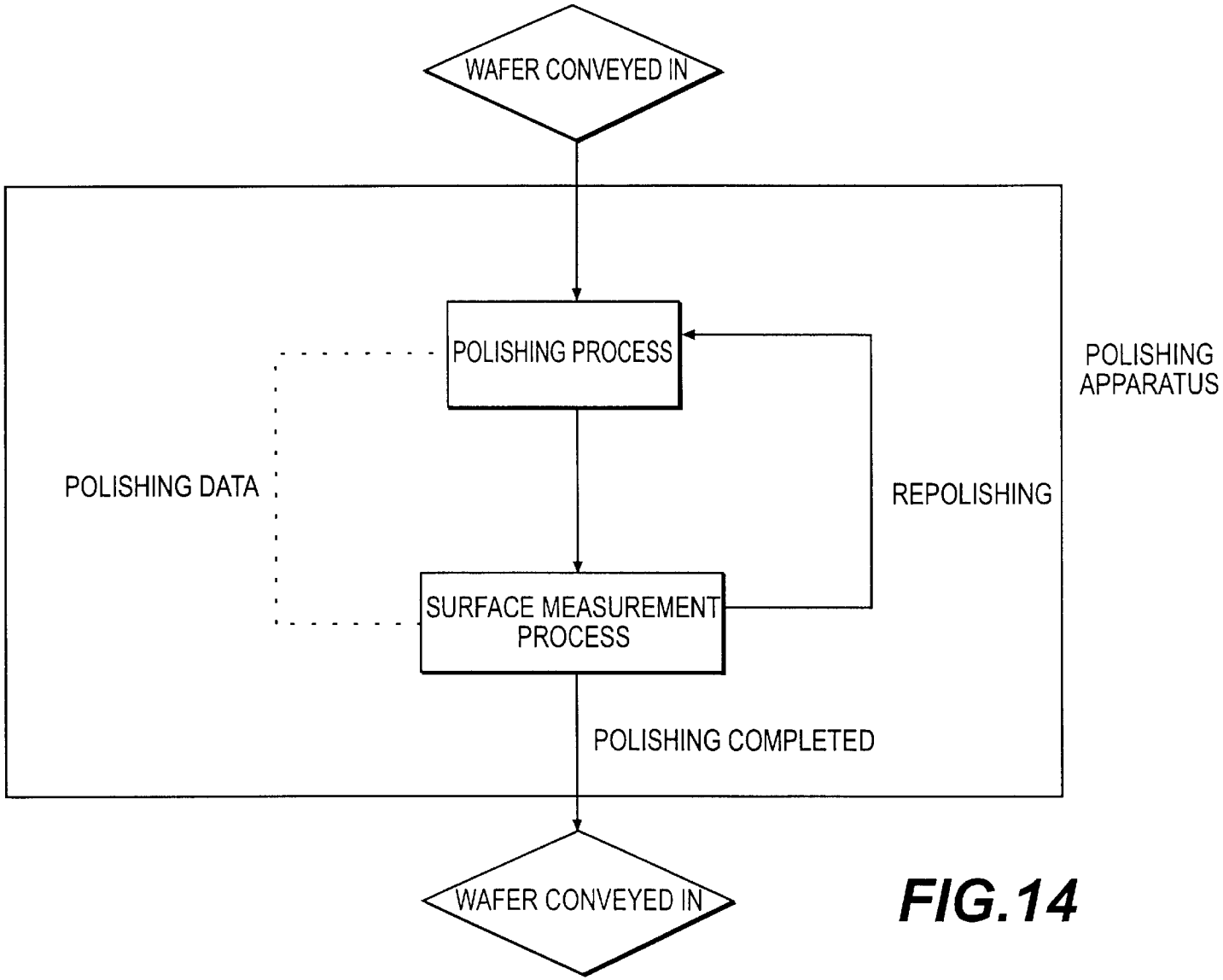
FIG. 14 is a flow chart that illustrates the polishing process, of the fourth embodiment 4 of the present invention.

The fourth embodiment of the present invention, as illustrated in FIGS. 13 and 14, will now be described in detail below. FIG. 13 is a schematic front view of a polishing apparatus of a fourth embodiment of the present invention and FIG. 14 is a flow chart that illustrates the polishing process of the fourth embodiment.

In the first through third embodiments, detection windows 225 are formed in the base plate 112 and an endpoint detection device 118 is installed beneath the base plate 112, so that endpoint detection is performed during polishing.

In the fourth embodiment of the present invention, on the other hand, the system is arranged as is shown in FIG. 13. The endpoint detection device 118 is positioned to the outside of the base plate 112 in the vicinity of the base plate 112. The wafer 115 held on the holder 114 is moved to a point that is outside and near the base plate 112 and is located above the endpoint detection device 118, so that direct endpoint detection is performed in a so-called in-line manner without base plate 112 or polishing agent interposed between the wafer 115 and the endpoint detection device 118.

The control of the relative positions and relative velocity V of the endpoint detection device 118 and wafer 115 makes it possible to measure the conditions of the polished surface or the film thickness in an arbitrary plural number of endpoint detection regions 419 in a short amount of time using the methods described in the above embodiments, without being restricted by the base plate 112.

In the system, as is shown in FIG. 14, a wafer 115 is conveyed into the polishing apparatus 111 and polished in a polishing process. In a surface measurement process, the film thickness or the conditions of the polished surface of the wafer 115 then are measured. The data are fed back to the polishing process as indicated by the broken line in FIG. 14. Where the polishing is found to be insufficient, on the basis of the measurement results, the wafer is returned to the polishing process and polished again. The polishing data thus fed back is useful for determining changes in the polishing characteristics over time and improving the reproducibility of the polishing process during the polishing of the next wafer 115.

Fifth Embodiment

Figure 15:
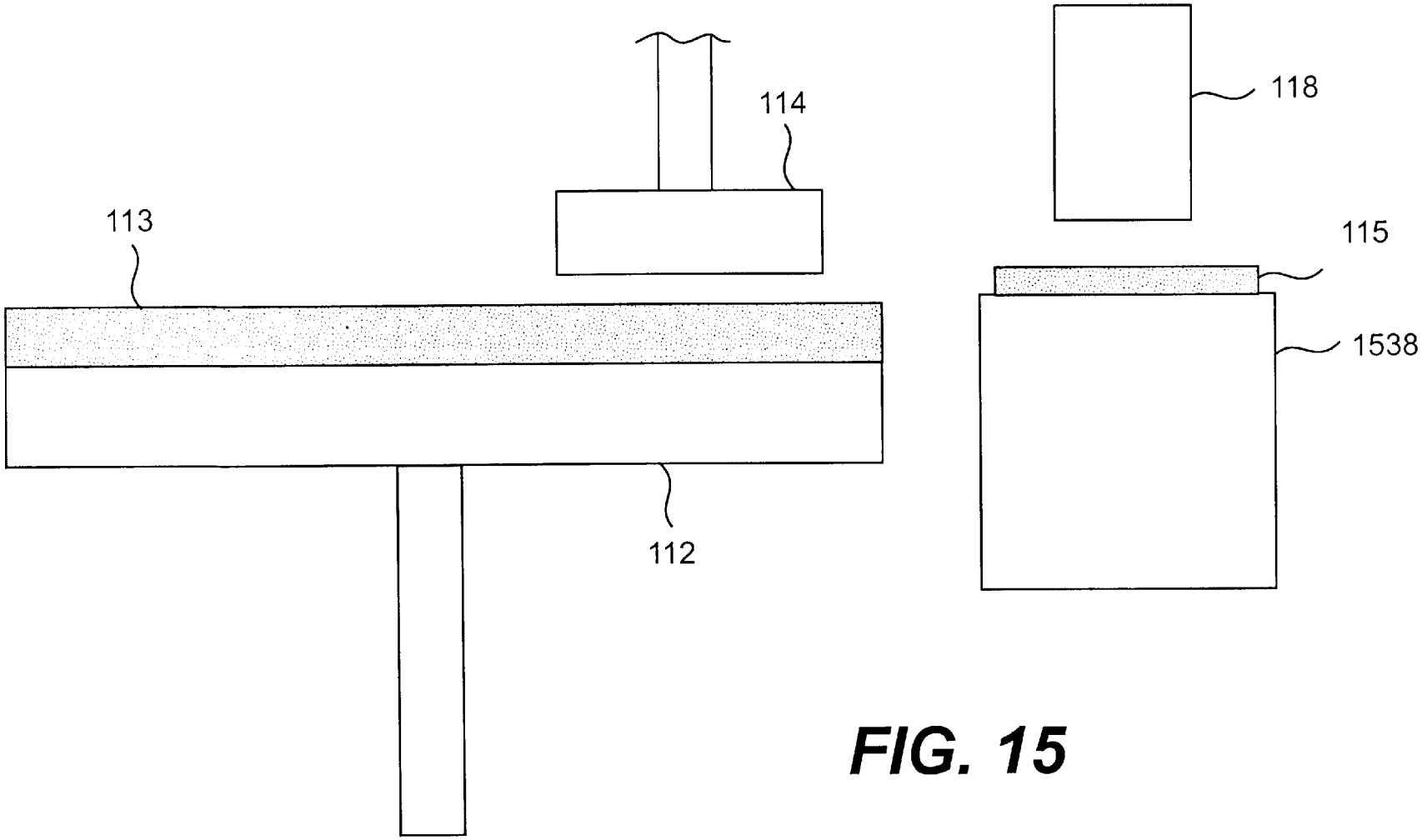
FIG. 15 is a schematic front view of a polishing apparatus of a fifth embodiment of the present invention.
Figure 16A:
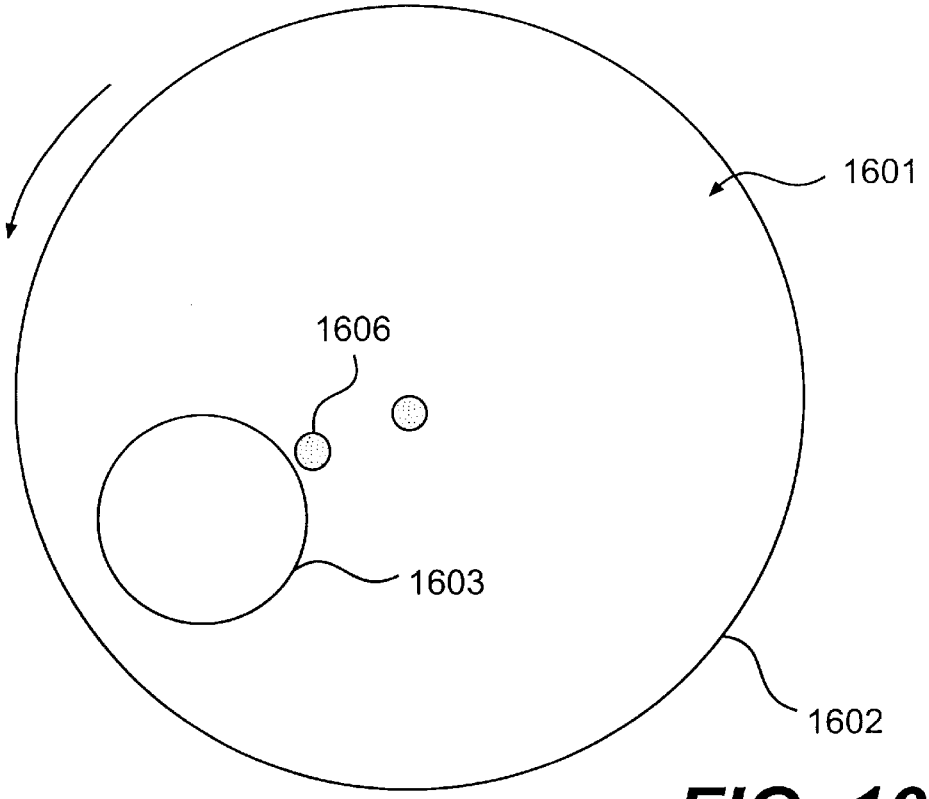
FIG. 16A PRIOR ART
FIG. 16A is a schematic plan view of a conventional polishing apparatus.
Figure 16B:
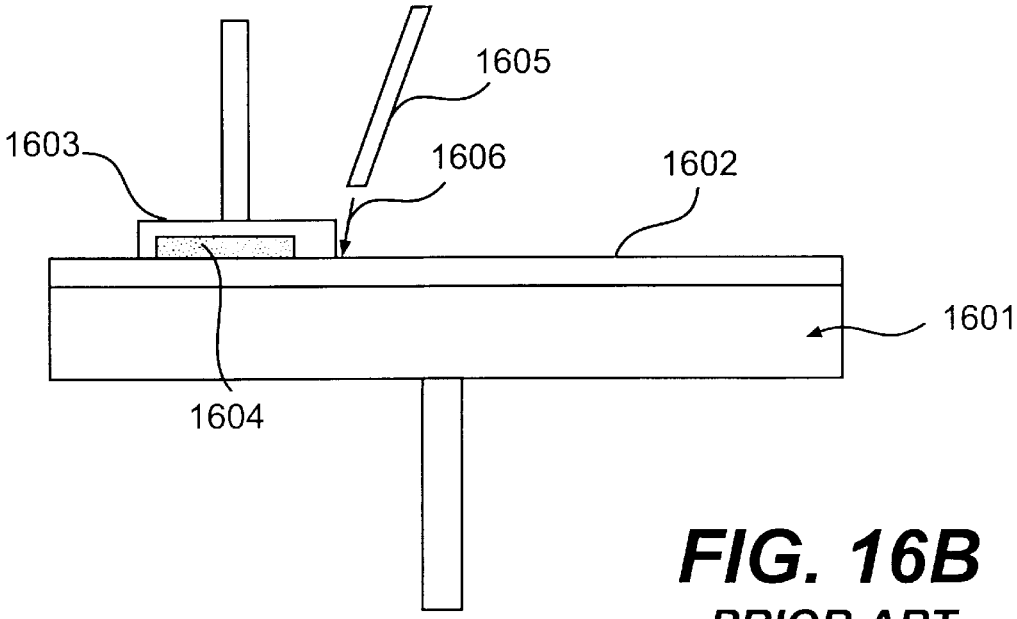
FIG. 16B PRIOR ART
FIG. 16B is a schematic front view of a conventional polishing apparatus.
Figure 17A:
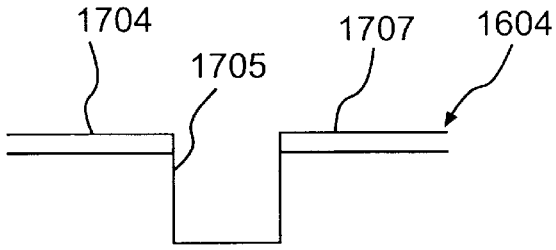
FIGS. 17A–17D are explanatory diagrams that illustrate a conventional technique of manufacturing a semiconductor device.
Figure 17B:
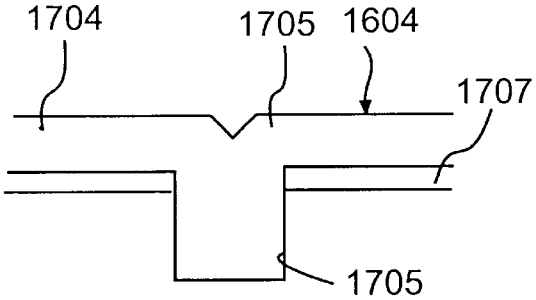
Figure 17C:
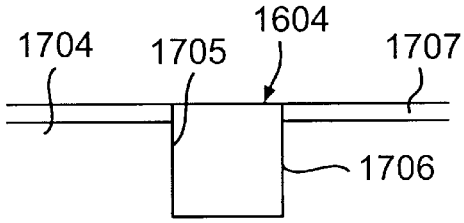
Figure 17D:
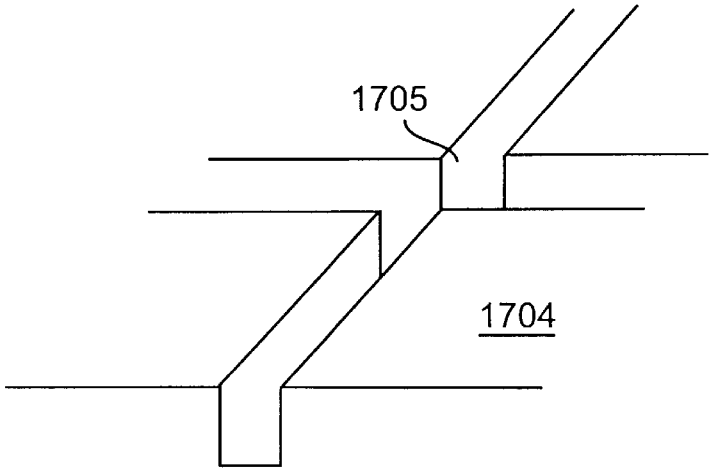
Figure 18A:
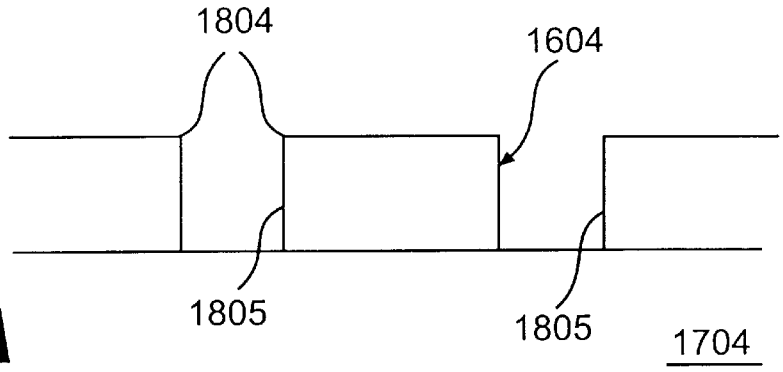
FIGS. 18A–18C are explanatory diagrams that illustrate a second conventional technique of manufacturing a semiconductor device.
Figure 18B:
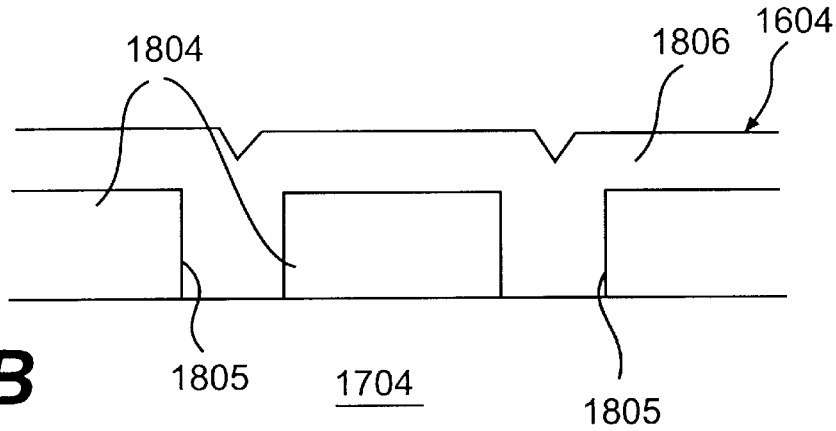
Figure 18C:
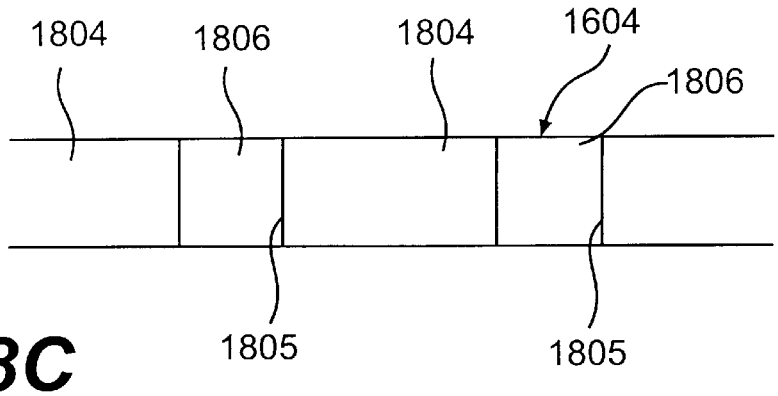

The fifth embodiment of the present invention, as illustrated in FIG. 15, will now be described in detail below. FIG. 15 is a schematic front view of a polishing apparatus of a fifth embodiment of the present invention.

In the fifth embodiment of the present invention, an endpoint detection stage 1538 is installed at a position to one side of the base plate 112 so that the stage is free to move in two dimensions and an endpoint detection device 118 is installed above the endpoint detection stage 1538.

In this system as well, no base plate 112, polishing pad 113, or polishing agent is interposed between the wafer 115 and the endpoint detection device 118. Accordingly, the film thickness or the conditions of the polished surface of the wafer can be measured in an arbitrary plural number of endpoint detection regions on the wafer 115 in a short amount of time in a so-called in-line manner without being restricted by the base plate 112, polishing pad 113, or polishing agent.

The remaining construction and operations of this embodiment are the same as in fourth embodiment. Except for the above described elements and their operation, the fifth embodiment is substantially identical to the operation of the fourth embodiment.

In the previous described embodiments, detection windows 225 were formed in portions of the base plate 112 and polishing pad 113 the "polishing body." However, the present invention is not limited to such a construction. It is possible to omit the detection windows 225 by forming the polishing body as a whole from a substance that transmits light. Furthermore, in the previously described first through fourth embodiments, the "polishing body" is constructed from a freely rotating base plate 112 and a polishing pad 113 installed on the surface of the base plate 112. However, the present invention is not limited to such a construction. It is also possible to construct the "polishing body" using a linearly moving belt, wherein such belt could also be formed from a substance that transmits light. Moreover, in the previously described first through fourth embodiments, the holder 114 and the endpoint detection device 118 were driven and controlled by means of first and second driving devices 117 and 120. However, the present embodiment is not limited to such a construction. It is also possible to control and drive only one of the aforementioned elements, i.e., either the holder 114 or the endpoint detection device 118, using only one of the aforementioned driving devices, i.e., either the first driving device 117 or the second driving device 120.

As described above, the relative positions of the optical measuring system and the polishing object are detected by a position detection system and the optical measuring system and/or the polishing object are controlled by a control system in accordance with signals from this position detection system so that prescribed endpoint detection regions on the polishing object can be measured by the optical measuring system. Accordingly, prescribed positions can be measured either during polishing or in an in-line manner, so that appropriate endpoint detection is possible.

Sixth Embodiment

The sixth embodiment of the present invention, as illustrated in FIGS. 21–26, will now be described in detail below.

In the present working configuration of the sixth embodiment of the present invention, the film thickness of the uppermost layer is measured using portions of the surface of the semiconductor substrate on which no circuit patterns are formed. Furthermore, in the present embodiment, the film thickness is inspected while CMP is performed.

Figure 21A:
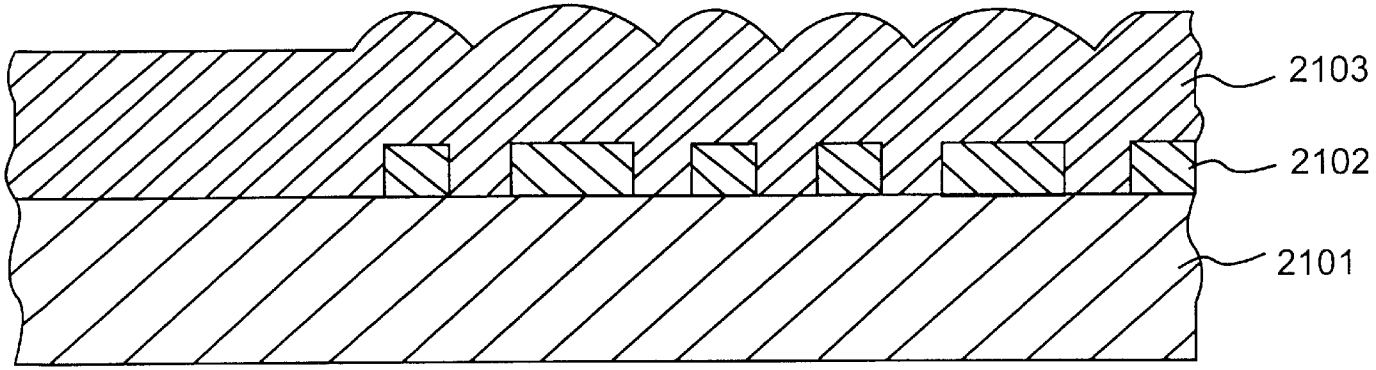
FIG. 21A illustrates a sectional view of a silicon substrate, which is the object to be polished, prior to the polishing of the substrate.
Figure 21B:
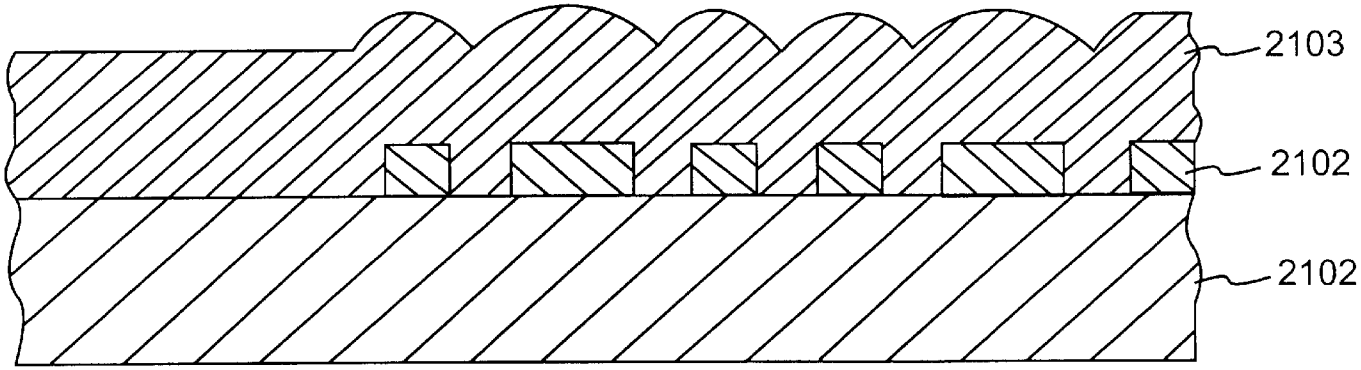
FIG. 21B is a sectional view of the silicon substrate showing the state of the substrate after polishing using a chemical mechanical polishing method.

FIG. 21A is a sectional view of the silicon substrate the object of detection of a film thickness detection method of the sixth embodiment of the present invention, showing the state of the substrate prior to polishing in the present invention, and FIG. 21B is a sectional view of the silicon substrate showing the state of the substrate after polishing.

In the sixth embodiment, as is shown in FIG. 21A, the polishing object is an assembly in which a wiring layer 2102 and an insulating layer 2103 (which is formed on top of the wiring layer 2102) are successively formed on the surface of a silicon substrate 2101. The wiring layer 2102 consists of gold, and is worked into a fine wiring pattern by photolithography. The insulating layer 2103, which is formed on top of the wiring layer 2102, consists of silicon dioxide; in its formed state, the insulating layer 2103 reflects the indentations and projections of the wiring layer 2102 as shown in FIG. 21A, so that complicated steps are formed in the surface of the insulating layer 2103. The surface of the insulating layer 2103 is polished by chemical mechanical polishing (CMP), thus flattening the surface as shown in FIG. 21B.

Figure 22:
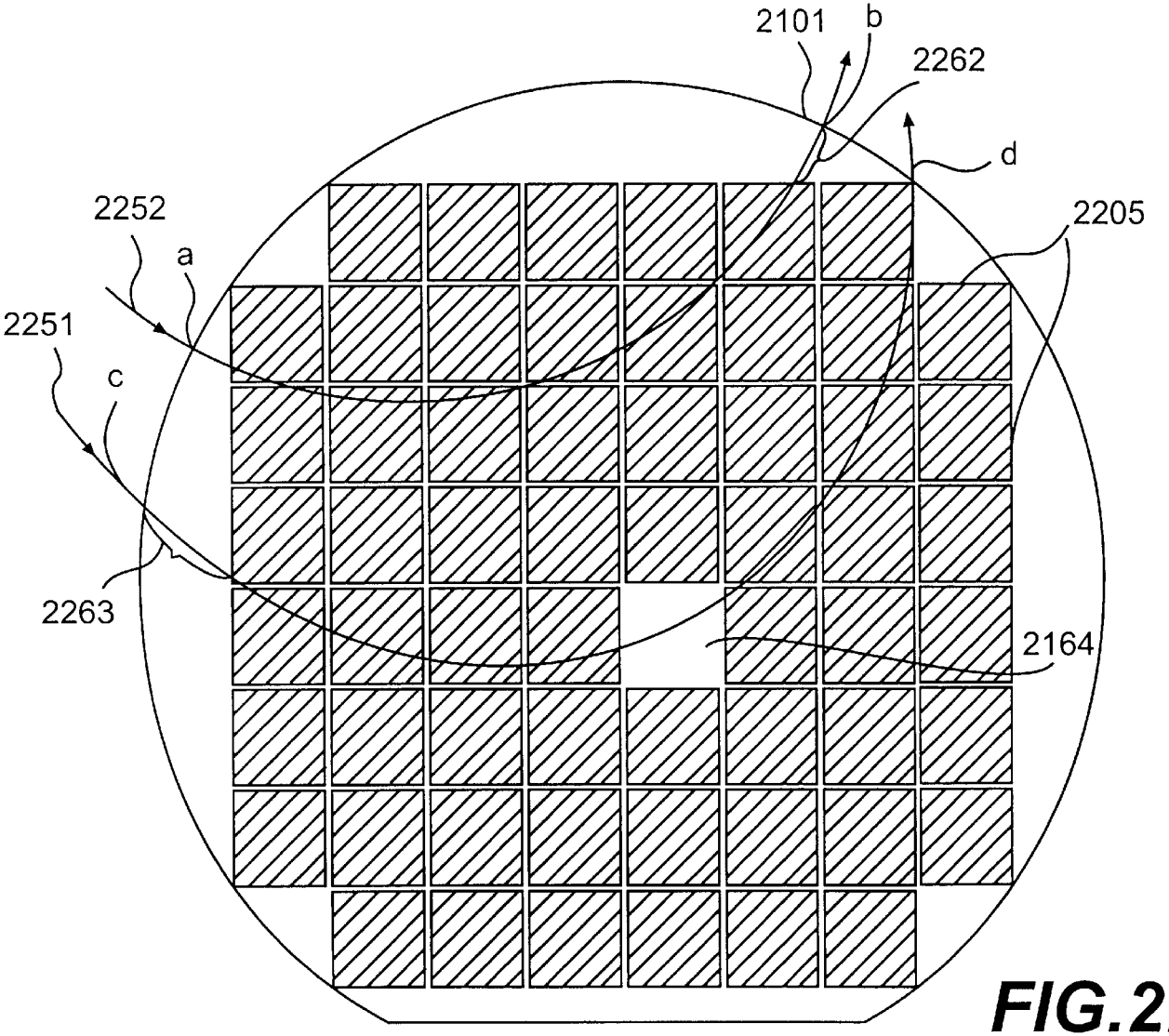
FIG. 22 is an explanatory diagram that illustrates the arrangement of the chip regions on the silicon substrate, which are the objects of detection of the film thickness detection method, and the paths followed by the inspection window of a sixth embodiment of the present invention.

FIG. 22 is an explanatory diagram that illustrates the arrangement of the chip regions on the silicon substrate, which are the objects of detection of the film thickness detection method, and the paths followed by the inspection window of the sixth embodiment of the present invention.

The wiring layer 2102 is disposed only in n chip regions 2205 on the surface of the silicon substrate 2101 as shown in FIG. 22. Accordingly, no wiring layer 2102 is present on the peripheral portions of the silicon substrate 2101 outside the chip regions 2205. Furthermore, in the present embodiment, a region 2264, in which no wiring layer 2102 is present, is also formed on the central portion of the silicon substrate 2101.

Figure 23B:
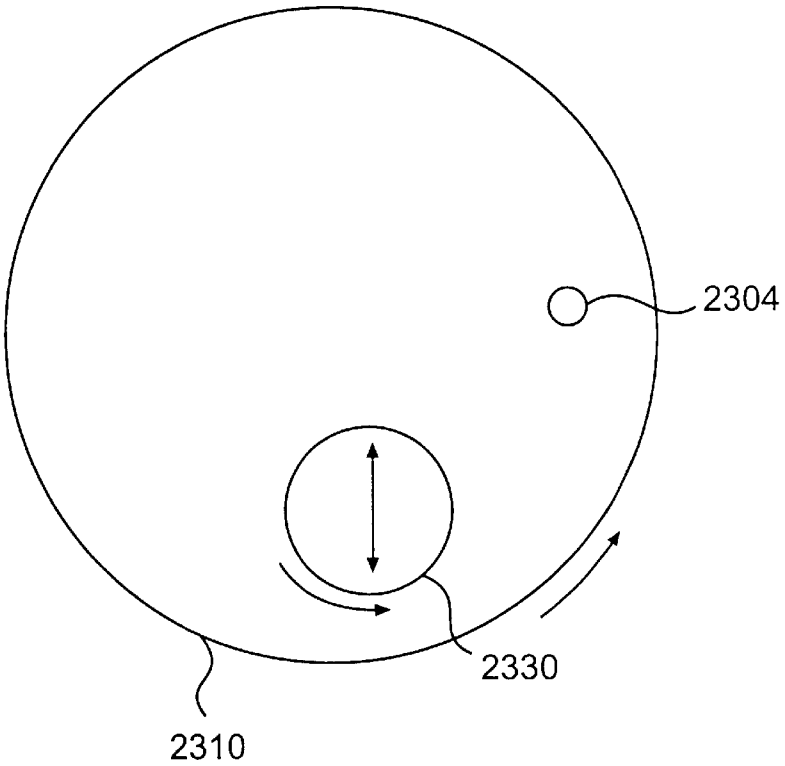
FIG. 23B is a plan view of the polishing apparatus used in a film thickness detection method of the sixth embodiment of the present invention.
Figure 23A:
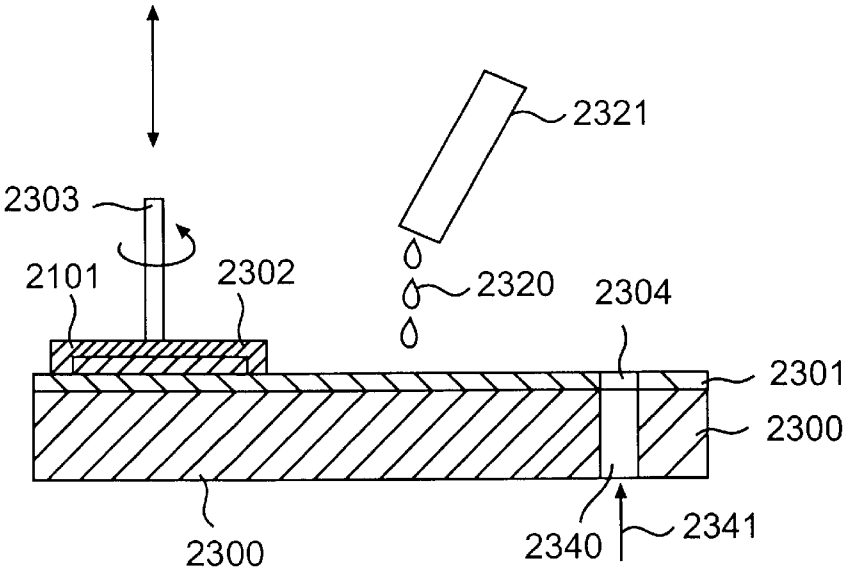
FIG. 23A is a sectional view of the polishing apparatus used in a film thickness detection method of the sixth embodiment of the present invention.

FIG. 23A is a sectional view of the polishing apparatus used in a film thickness detection method of the sixth embodiment of the present invention, and FIG. 23B is a plan view of the polishing apparatus used in a film thickness detection method of the sixth embodiment.

The polishing apparatus used for CMP is constructed as shown in FIGS. 23A and 23B. Specifically, a polishing cloth 2301 is bonded to the surface of a base plate 2300. The silicon substrate 2101 is held in a holder 2302 with the insulating layer 2103 (not visible in this drawing) that is to be polished facing downward, and is placed on the surface of the polishing cloth 2301. A predetermined load is applied by means of a driving device (not shown in the figures) to a supporting fitting 2303 which is attached to the holder 2302. The supporting fitting 2303 is rotationally driven so that the silicon substrate 2101 is caused to rotate, and is also driven so that the silicon substrate 2101 is caused to move in the radial direction of the base plate 2300.

A through-hole 2340 is formed in the base plate 2300 in order to allow illumination with illuminating light 2341, which is used to measure the film thickness of the insulating layer 2103 on the silicon substrate 2101 during polishing. An optical window 2304 is set into the upper portion of the through-hole 2340, and no polishing cloth 2301 is disposed in the area of the optical window 2304. The material of the optical window 2304 may be any material that is transparent to the wavelength of the illuminating light 2341. For example, if visible light is used as the illuminating light 2341, an acrylic material, PET (polyethylene terephthalate), glass, or similar material may be used as the material of the optical window 2304.

A polishing agent discharge part 2321, which is used to drip a polishing agent onto the surface of the polishing cloth 2301, is installed above the base plate 2300. The polishing agent contains abrasive polishing particles and an alkali that dissolves the insulating layer 2103 .

Figure 24:
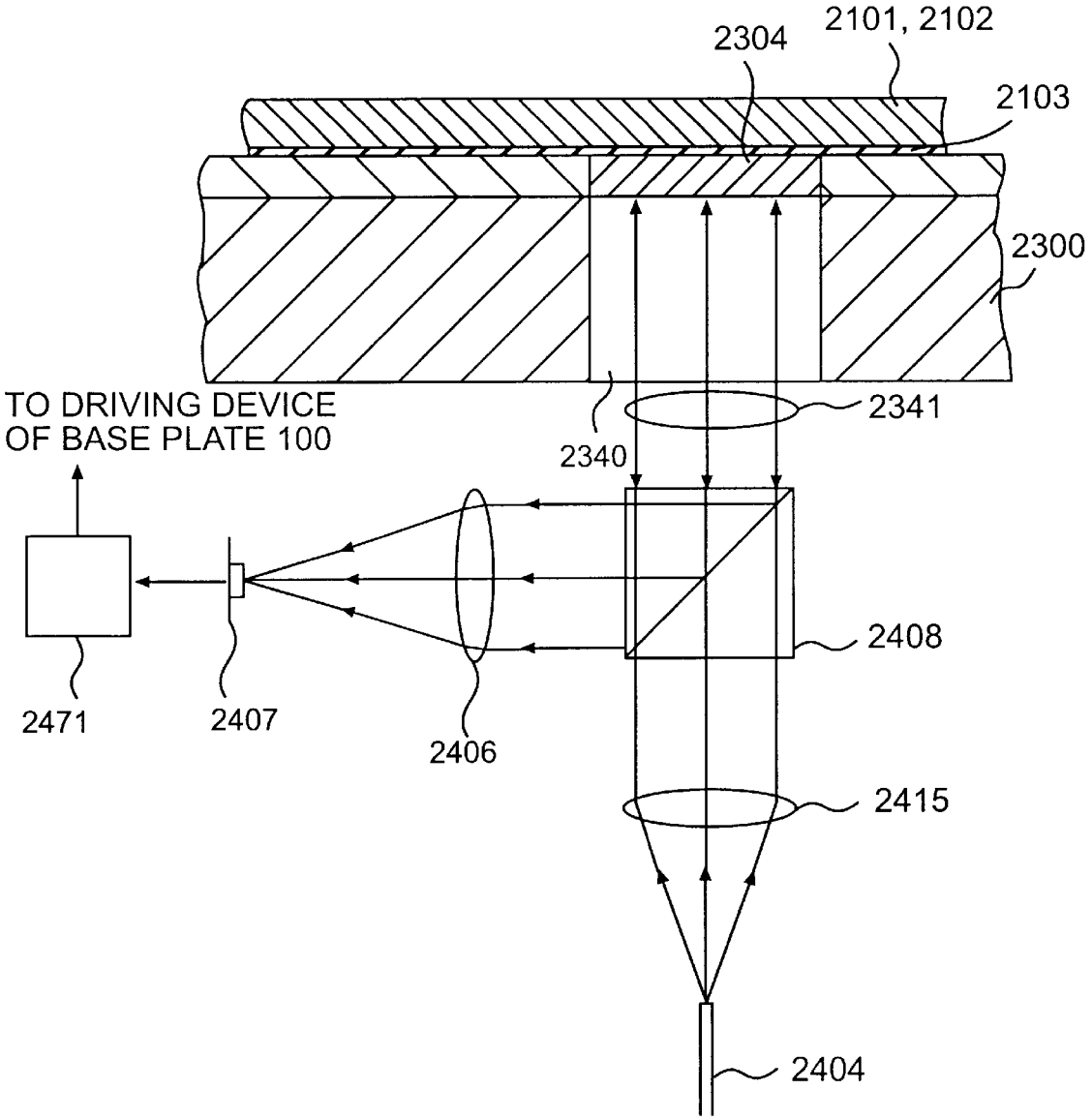
FIG. 24 is an explanatory diagram that illustrates the construction of the film thickness optical detection system and the inspection window in the base plate used in a film thickness detection method of the sixth embodiment of the present invention.

FIG. 24 is an explanatory diagram that illustrates the construction of the film thickness optical detection system and the inspection window in the base plate used in a film thickness detection method of the sixth embodiment of the present invention.

A film thickness measuring optical system is attached to the base plate 2300 beneath the through-hole 2340 in the base plate 2300. As is shown in FIG. 24, the film thickness measuring optical system includes an optical fiber 2404 that propagates light from a white light source, such as a halogen lamp (not shown in the figures), and emits the light vertically toward the optical window 2304 as illuminating light 2341, a collimator lens 2415 that collimates the illuminating light 2341, a beam splitter 2408, a focusing lens 2406 that focuses the returning reflected light including the illuminating light 2341 reflected by the insulating layer 2103, and a detector 2407 that detects the returning reflected light. The focusing lens 2406 and detector 2407 are installed in the light path of the returning reflected light deflected by the beam splitter 2408. The output of the detector 2407 is inputted into a control device 2471, which is used to detect the film thickness of the insulating layer 2103 at the current point in time. Since the film thickness measuring optical system is attached to the base plate 2300, the system rotates together with the base plate 2300.

The operation by which the film thickness is detected during CMP using the film thickness detection apparatus will now be described in detail.

In the CMP operation, as shown in FIG. 23A, a polishing agent is supplied to the surface of the polishing cloth from the polishing agent discharge part 2321. Furthermore a prescribed load is applied, by means of a driving device (not shown in the figures), to the silicon substrate 2101 from the supporting fitting 2303. As the load is being applied, the silicon substrate 2101 is caused to rotate at a prescribed speed and is also caused to perform a reciprocating motion in the radial direction of the base plate 2300. Furthermore, the base plate 2300 is caused to rotate at a prescribed speed. As a result, the silicon substrate 2101 slides over the surface of the base plate 2300 while traversing a fixed track, so that chemical mechanical polishing of the insulating layer 2103 proceeds by means of the polishing agent 2320 and polishing cloth 2301.

The illuminating light 2341 is emitted from the optical fiber 2404 of the film thickness optical inspection system attached to the underside of the base plate 2300 while the insulating layer 2103 is thus polished. The illuminating light 2341 is directed onto the insulating layer 2103 via the through-hole 2340 and optical window 2304 after being collimated by the collimator lens 2415 and passing through the beam splitter 2408 as shown in FIG. 24. A portion of the illuminating light 2341 is reflected by the surface of the insulating layer 2103. The remaining illuminating light 2341 passes through the insulating layer 2103, and is reflected by the interface between the insulating layer 2103 and the silicon substrate 2101, or by the interface between the insulating layer 2103 and the wiring layer 2102. The light reflected from the surface of the insulating layer 2103 and the light reflected from the interfaces are both reflected by the beam splitter 2408 and focused by the focusing lens 2406. The interference light created by both beams of reflected light is detected by the detector 2407. The output of the detector 2407 is inputted into the control device 2471, and the film thickness of the insulating layer 2103 is detected from the frequency of the interference light.

The silicon wafer 2101 moves while traversing a fixed track on the base plate 2300, and the film thickness optical inspection system detects the film thickness of the insulating layer 2103 on the portion of the silicon substrate 2101 that passes over the optical window 2304. However, in the regions in which the wiring layer 2102 is disposed, the film thickness of the insulating layer 2103 differs between areas where wiring is present and areas where wiring is absent, and the reflectivity also varies. As a result, the output level of the detector 2407 is not stable. Accordingly, in the present embodiment, returning light reflected from a region in which no wiring layer 2102 is installed on the silicon substrate 2101 is utilized. This will be described in further detail below.

Figure 27A:
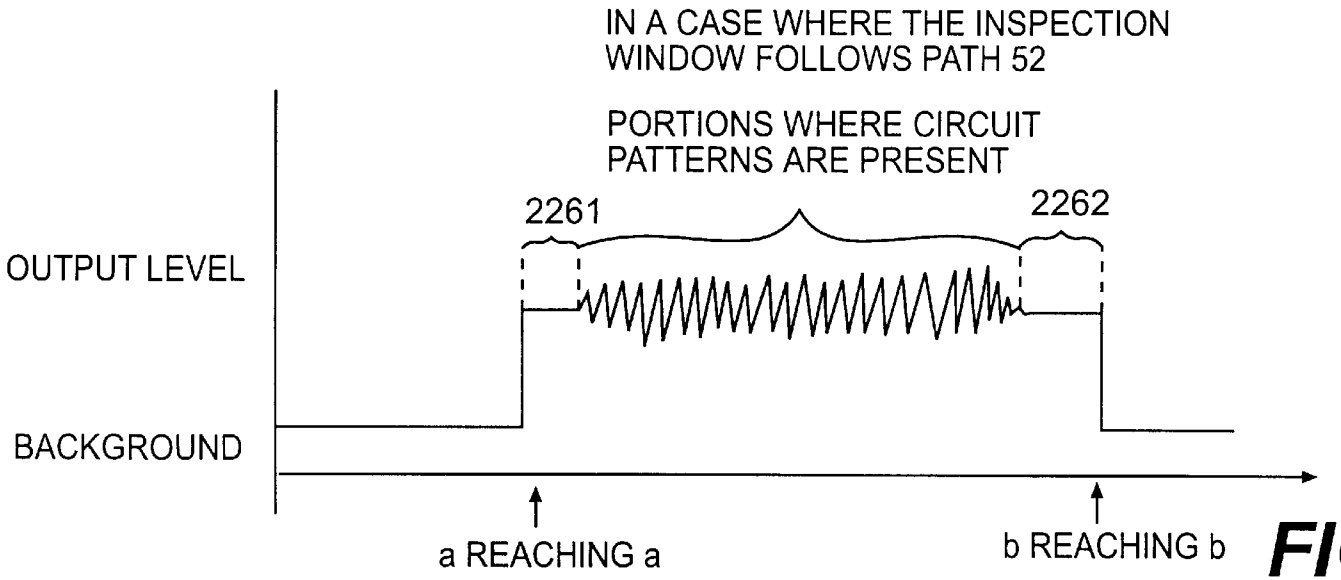
FIGS. 27A and 27B are explanatory diagrams showing changes in the output level of the detector of the film thickness inspection optical system in a film thickness inspection method of the sixth embodiment of the present invention.

The silicon substrate 2101 moves while traversing a fixed track on the base plate 2300 during polishing, the silicon wafer 2101 periodically cuts across the optical window 2304 any number of times. The output level of the detector 2407 is the background level when the silicon wafer 2101 is not above the optical window 2304. When the silicon wafer 2101 passes over the upper portion of the optical window 2304, an output based on the light reflected from the insulating layer 2103 is obtained. For example, where the path by which the silicon wafer 2101 passes over the optical window 2304 is the path 2152 in FIG. 22, the output level of the detector 2407 increases as shown in FIG. 27A when the edge a of the silicon substrate 2101 reaches the optical window 2304. Furthermore, while the peripheral region 2161 is passing over the optical window 2304, the output level is constant, as shown in FIG. 27A, since no wiring layer 2102 is installed in the region 2161.

However, while chip regions 2105 are passing over the optical window 2304, the output level becomes unstable due to the influence of the wiring layer 2. Then, when the peripheral region 2262 again reaches the optical window 2304, the output level becomes constant, and beyond the edge b, the output level once again drops to the background level.

Figure 27B:
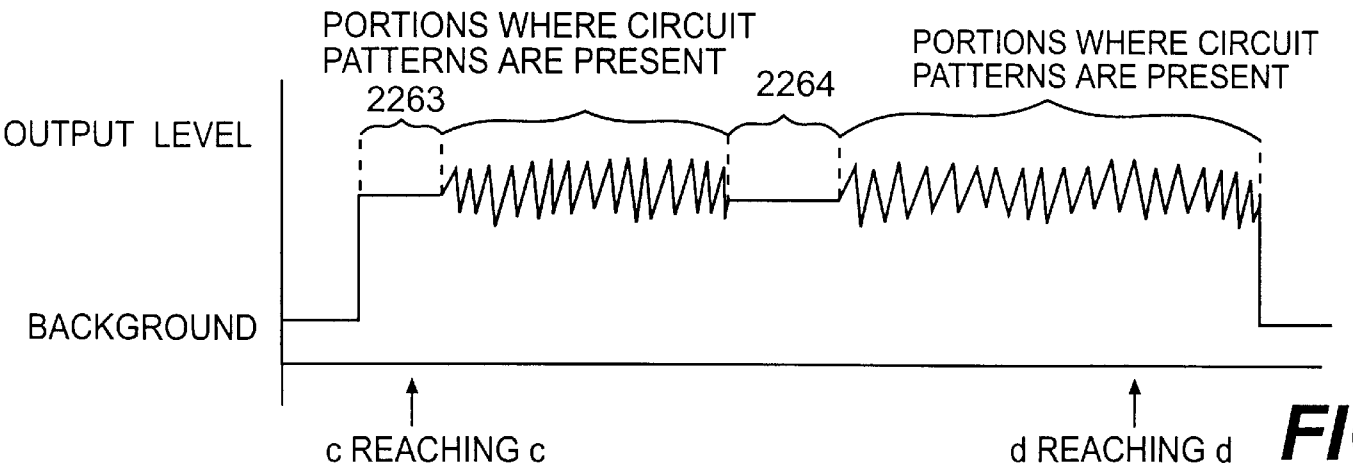

On the other hand, where the path by which the silicon substrate 2101 cuts across the optical window 2304 is the path 2151, as shown in FIG. 22, the output level of the detector 2407 increases, as shown in FIG. 27B when the edge c of the silicon substrate 2101 reaches the optical window 2304. Then, while the peripheral region 2263 is passing over the optical window 2304, the output level is constant, as shown in FIG. 27B, since no wiring layer 2102 is installed in the region 2263.

However, while the optical window 2304 is passing over the chip regions 2205, the output level becomes unstable due to the influence of the wiring layer 2, and while the optical window 2304 is passing over the region 2264, the output level again becomes stable. Then, while the optical window 2304 is passing over the chip regions 2205, the output level becomes unstable, and when the optical window 2304 moves beyond the edge d, the output level again returns to the background level.

Thus, the output level is constant in areas where no wiring layer 2102 is installed. Utilizing this fact, the control device 2471 selects signal regions where the output level is flat in the output of the detector 2407, and thus selects output signals in the regions 2161, 2162, 2163, and 2164. The film thickness is then detected using the output from such regions. As a result, the film thickness can be detected in the regions 2161, 2162, 2163, and 2164 without being affected by the wiring layer 2.

Two different methods may be used by the control device 2471 to select a region in which the output level of the detector 2407 is flat. One method requires that variation in the output level be detected and the signal in a region where the variation is small is selected. The other method requires that the rise or fall in the output level at edge a or edge c is detected, and the output immediately following the rise or immediately before the fall is selected as the signal region. In regard to the construction used by the control device 2471 in order to detect such a signal region, either a construction including a combination of a computer and a program run by the computer that searches for a region in which the output level is flat by storing detection signals temporarily in a memory device and processing the signals according to the program, or a construction consisting of an analog signal processing circuit that searches for a region in which the output signal level is flat, may be used.

The control device 2471 causes polishing to be continued until the detected film thickness reaches a certain predetermined thickness. When it is detected that the predetermined thickness has been reached, the control device 2471 instructs the driving devices of the base plate 2300 and the holder 2302 to stop, and polishing is completed.

Thus, in the film thickness inspection method of the present embodiment, the film thickness of the insulating layer 2103 is detected in regions in which no wiring layer 2102 is installed on the surface of the silicon wafer 2101. As a result, the film thickness can be detected with a high precision, without being affected by the wiring layer 2102. Accordingly, polishing can be accurately completed when the desired film thickness is reached, so that the shape precision and yield of semiconductor integrated circuits can be improved.

In the film thickness inspection method of the present embodiment, the film thickness can be accurately measured at intermediate points in the polishing process while polishing is being performed. Accordingly, there is no need to interrupt polishing in order to inspect the film thickness and the manufacturing efficiency can therefore be improved.

In the film thickness inspection method of the present embodiment, a region 2164 when no wiring layer 2102 is installed is formed near the center of the substrate 2101 as shown in FIG. 22. Accordingly, the probability that the optical window 2304 will pass through two or more regions in which no wiring layer 2102 is installed is increased. As a result, the probability that the film thickness can be inspected at two or more locations on one wafer is increased. Consequently, the precision of film thickness detection can be increased and the distribution of the film thickness can also be detected.

The present invention is not limited to film thickness inspection on substrates 2101 in which the region 2164 is formed near the center of the silicon substrate 2101. It is also possible to apply the present invention to ordinary silicon substrates that have regions where no wiring layer 2102 is installed or are present only on the peripheral portions of the substrate 2101.

Furthermore, as a separate embodiment of the present invention, it is also possible to interrupt polishing temporarily, or to inspect the film thickness in regions of the substrate containing no wiring layer 2102 after polishing has been completed, instead of measuring the film thickness during polishing as described above. The film thickness of the insulating layer 2103 can; therefore, be inspected with a high precision (without being influenced by the wiring layer 2) by selecting and inspecting regions in which no wiring layer 2102 is installed. This method is appropriate as a film thickness inspection method for determining the relationship between polishing time and film thickness beforehand in order to determine the polishing time in cases where the completion of the CMP process is controlled on the basis of the polishing time.

Figure 25:
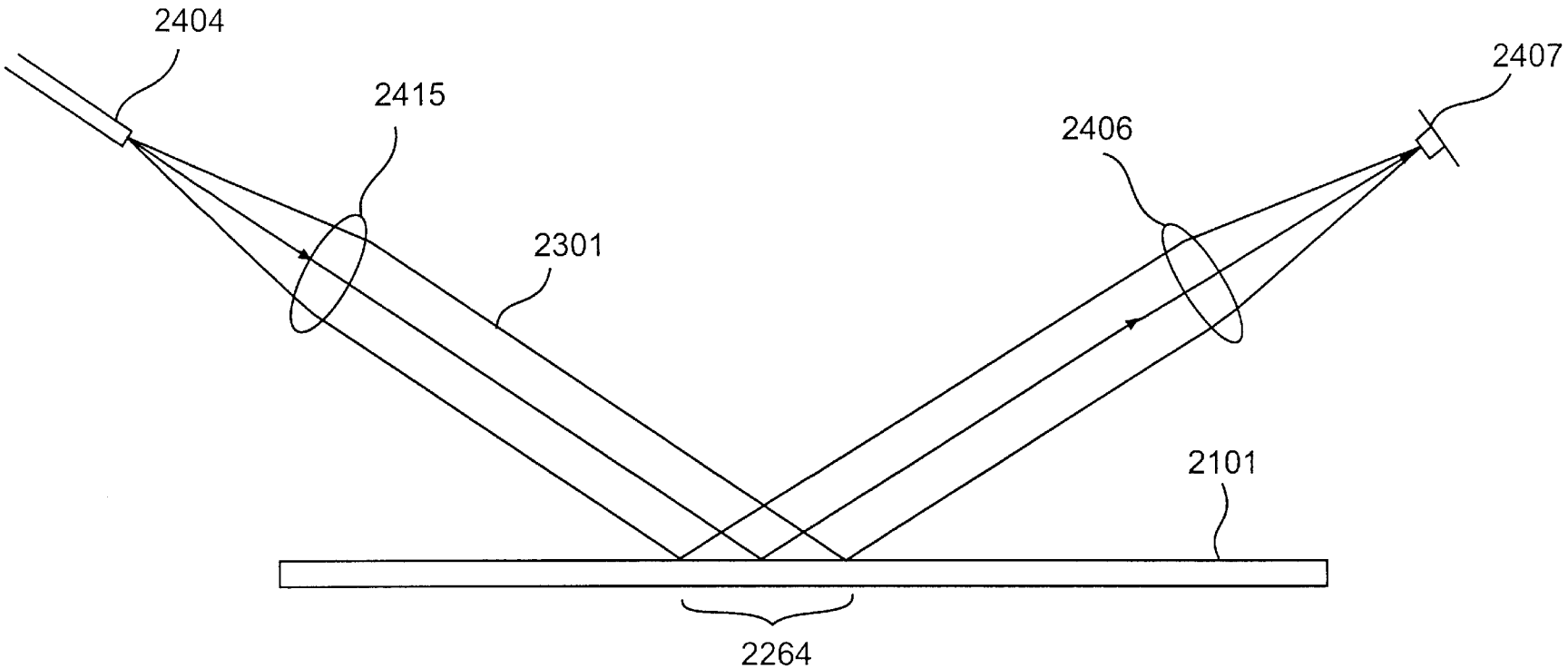
FIG. 25 is a block diagram illustrating the construction of the optical detection system used in a film thickness detection method of the sixth embodiment of the present invention.
Figure 26:
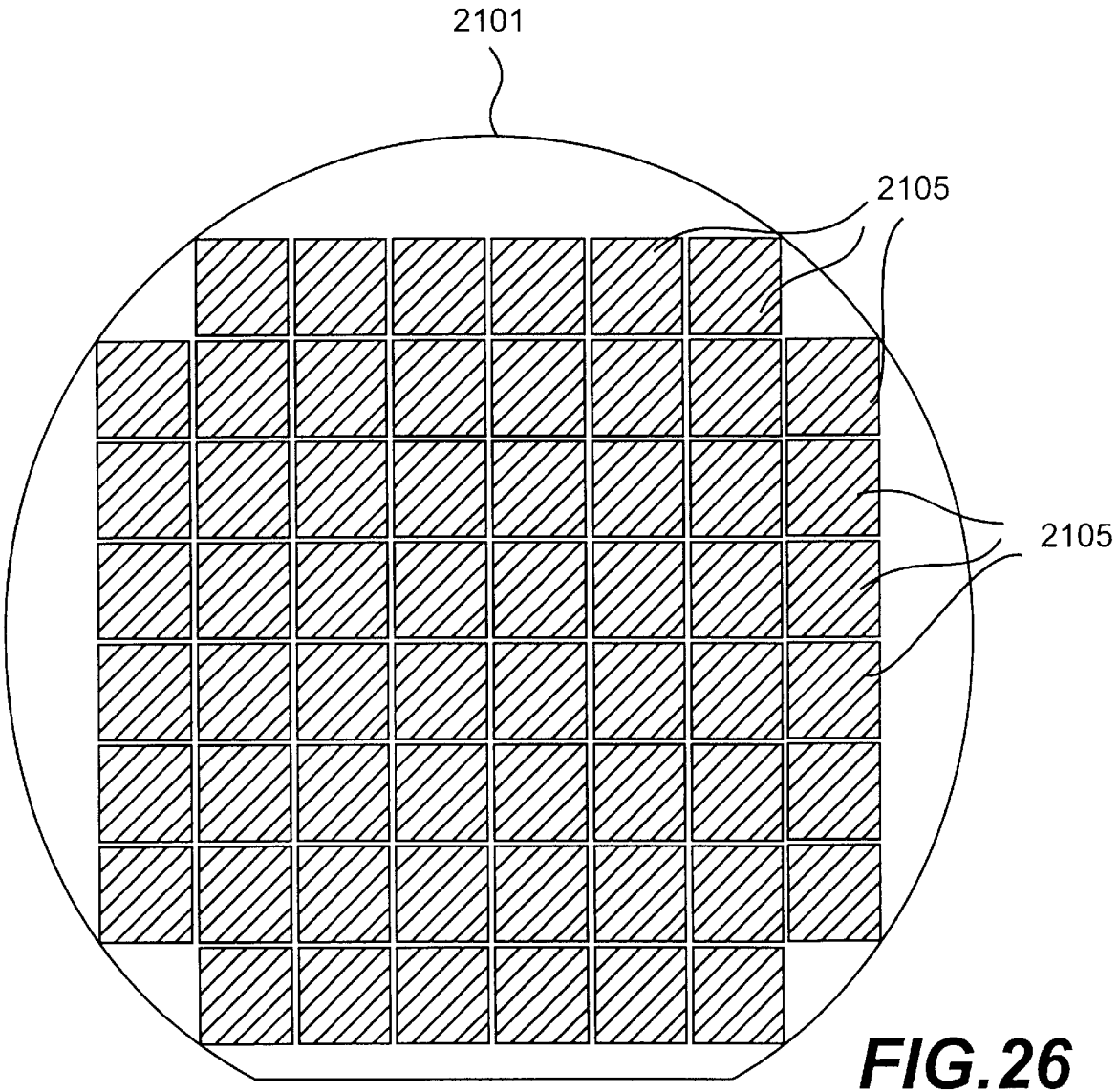
FIG. 26 is an explanatory diagram that illustrates the arrangement of the chip regions on a silicon substrate used in a film thickness detection method of the sixth embodiment of the present invention.

Furthermore, in cases where the film thickness is thus inspected during an interruption in the polishing process or after polishing is completed, an optical system that causes light to be incident on the substrate 2101 from an oblique direction, as shown in FIG. 25, can be used as the film thickness inspection optical system.

Furthermore, in embodiments discussed, film thickness inspection in the case of CMP type polishing of an insulating layer 2103 on a silicon substrate 2101 with a structure such as that shown in FIGS. 26A and 26B, was described. However, the present invention is not limited to measurement of the film thickness of insulating layers. In cases where the outermost layer laminated on a silicon substrate 2101 is a layer which is polished by CMP, the film thickness inspection method of the present invention can be used regardless of the material of the outermost layer. Furthermore, depending on the film thickness inspection method used, it may also be possible to measure the film thickness of the surface layer assembly as a whole, including second and subsequent layers, rather than just the outermost layer.

Furthermore, in the above embodiments, the film thickness in regions in which no wiring layer 2102 was installed was detected by continuously detecting the output level of the detector 2407, and selectively using signals in which the output level was constant. However, it would also be possible to detect the film thickness in regions containing no wiring layer 2102 by utilizing the fact that the track of the silicon wafer 2101 on the base plate 2300 is fixed.

For example, in the case of the silicon wafer 2101 shown in FIG. 22, the track described by the region 2264 on the surface of the base plate 2300 is determined by the rotational speed of the base plate 2300, the rotational speed of the substrate 2101, and the speed of the reciprocating motion of the substrate 2101. Accordingly, if the track of the region 2264 is determined by calculation beforehand, the time at which the track will pass over the optical window 2304 following the initiation of polishing can be ascertained. Thus, if the substrate 2101 is illuminated with the illuminating light 2440 when a predetermined amount of time has elapsed following the initiation of polishing, and the output of the detector 2407 is selectively taken in by the control device 2471, the film thickness can be determined from the output signal.

The film thickness of the outermost layer in regions containing no wiring layer 2102 can also be detected using this method. The period at which the substrate 2101 passes over the optical window 2304 may be extremely long in some applications of the film detection method, depending on the configuration of the track the devices traverses. Where the period is long, as described above, the arrival of the film thickness at the desired film thickness cannot be detected with accurate timing. Accordingly, it is desirable to set the position of the region 2264, the rotational speed of the base plate 2300, the rotational speed of the substrate 2101, and the speed and range of the reciprocating motion of the substrate 2101, so that the region 2264 passes over the optical window 2304 each time the substrate 2101 makes one circuit over the base plate 2300.

If the detection is performed in peripheral regions of the silicon substrate 2101, in which no wiring layer 2102 is installed, such peripheral portions pass over the optical window 2304 at least once regardless of which portions of the silicon substrate 2101 cut across the optical window 2304. Accordingly, the film thickness can similarly be detected with good precision by determining beforehand the instant in time at which such peripheral regions containing no wiring layer 2102 passes over the optical window 2304.

As was described above, the present invention provides a film thickness inspection method that makes it possible to measure, with a high precision, the film thickness of the outermost layers on semiconductor substrates which have circuit patterns formed on the underlayers.

It will be apparent to those skilled in the art that various modifications and variations can be made in the film thickness polishing apparatus and inspection method of the present invention without departing from the spirit or scope of the invention. Thus, it is intended that the present invention cover the modifications and variations of this invention provided they come within the scope of the appended claims and their equivalents.

What is claimed is:

1. A film thickness inspection method that optically detects a film thickness of an outermost layer of a semiconductor substrate, the semiconductor substrate having chip regions and non-chip regions such that wiring patterns are formed on the chip regions and not on the non-chip regions, the film thickness inspection method comprising the steps of:

selecting non-chip regions on the semiconductor substrate; and optically detecting the film thickness of the outermost layer of the semiconductor substrate by illuminating the non-chip regions with light.

2. A film thickness inspection method comprising the steps of:

polishing an outermost layer of a semiconductor substrate, the semiconductor substrate including wiring patterns formed thereon in predetermined chip regions;

contacting the outermost layer of the semiconductor substrate to a base plate and rotating the base plate;

illuminating the outermost layer of the semiconductor substrate with light through a window formed in a surface of the base plate while the polishing is being performed;

detecting reflected light from the semiconductor substrate;

selecting a detection signal produced from the reflected light when a non-chip region of the semiconductor substrate passes over the window formed in the base plate; and determining a film thickness of the outermost layer of the semiconductor substrate from the selected detection signal.

3. The film thickness inspection method according to claim 2, wherein the base plate is stopped and polishing is completed when the determined thickness of the outermost layer of the semiconductor substrate reaches a predetermined film thickness.

4. The film thickness inspection method according to claim 2, wherein the detection signal produced when the non-chip region passes over the window is selected by selecting a detection signal region in which an output level of the detection signal is flat.

5. The film thickness inspection method according to claim 2, wherein the detection signal produced when the non-chip region passes over the window is selected by selecting the detection signal that is produced when a peripheral portion of the semiconductor substrate passes over the window.

6. A film thickness inspection method comprising the steps of:

polishing an outermost layer on a semiconductor substrate, wherein the semiconductor substrate includes wiring patterns formed in predetermined chip regions and wherein polishing is accomplished by causing the outermost layer of the semiconductor substrate to contact a rotating base plate;

illuminating the outermost layer of the semiconductor substrate during polishing when non-chip regions of the semiconductor substrate passes over a window formed in the base plate;

detecting light reflected from the non-chip regions; and determining a film thickness of the outermost layer of the semiconductor substrate.

* * * * *